US009227416B2

(12) United States Patent
Otobe

(10) Patent No.: US 9,227,416 B2
(45) Date of Patent: Jan. 5, 2016

(54) LIQUID CARTRIDGE, IMAGE RECORDING DEVICE, AND SUBSTRATE

(71) Applicant: Mutsumi Otobe, Nagoya (JP)

(72) Inventor: Mutsumi Otobe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/455,828

(22) Filed: Aug. 8, 2014

(65) Prior Publication Data

US 2014/0347428 A1 Nov. 27, 2014

Related U.S. Application Data

(62) Division of application No. 13/192,180, filed on Jul. 27, 2011, now Pat. No. 8,801,161.

(51) Int. Cl.

| | |
|---|---|
| ***B41J 2/175*** | (2006.01) |
| ***B41J 29/393*** | (2006.01) |
| ***B41J 2/14*** | (2006.01) |

(52) U.S. Cl.

CPC ..... *B41J 2/1753* (2013.01); *B41J 2/1752* (2013.01); *B41J 2/17596* (2013.01); *Y10T 137/8376* (2015.04)

(58) Field of Classification Search

CPC .... B41J 2/17546; B41J 2/1753; B41J 2/1752; B41J 2/17523; B41J 2/17526; B41J 2/17553; B41J 2/17503; B41J 2/17513; B41J 2/17596

USPC ..... 347/9, 19, 50, 84, 85, 86

See application file for complete search history.

(56) References Cited

U.S. PATENT DOCUMENTS

| | | | |
|---|---|---|---|
| 5,411,343 | A | 5/1995 | Childers |
| 5,646,660 | A | 7/1997 | Murray |
| 6,164,743 | A | 12/2000 | Hmelar et al. |
| 2002/0033855 | A1 | 3/2002 | Kubota et al. |

(Continued)

FOREIGN PATENT DOCUMENTS

| | | | |
|---|---|---|---|
| CN | 1576023 | A | 2/2005 |
| CN | 1727188 | A | 2/2006 |

(Continued)

OTHER PUBLICATIONS

The State Intellectual Property Office of the People's Republic of China, Notification of First Office Action for Chinese Patent Application No. 201110220910.7 (counterpart to co-pending U.S. Appl. No. 13/192,180), issued Apr. 1, 2014.

(Continued)

*Primary Examiner* — Jannelle M Lebron

(74) *Attorney, Agent, or Firm* — Baker Botts L.L.P.

(57) ABSTRACT

A liquid cartridge includes a liquid reservoir, a liquid flow path that selectively places the reservoir in fluid communication with an exterior of the cartridge, a sensor that outputs a signal relative to a position of an object in the liquid flow path, a storage that stores data therein, and a plurality of terminals. The plurality of terminals includes a sensor terminal connected to the sensor, a power terminal connected to at least one of the sensor and the storage, and that receives power, and a data terminal connected to the storage. A distance between a first portion of the power terminal and at least a portion of the data terminal is greater than a distance between a second portion of the power terminal and at least a portion of the sensor terminal.

27 Claims, 21 Drawing Sheets

(56) References Cited

U.S. PATENT DOCUMENTS

| | | | | |
|---|---|---|---|---|
| 2005/0007401 | A1 | 1/2005 | Katayama | |
| 2006/0017755 | A1 | 1/2006 | Shinada | |
| 2006/0250461 | A1* | 11/2006 | Silverbrook et al. | 347/86 |
| 2008/0211838 | A1 | 9/2008 | Zhang | |
| 2009/0051746 | A1 | 2/2009 | Asauchi | |
| 2009/0237426 | A1 | 9/2009 | Kimura | |
| 2010/0091070 | A1 | 4/2010 | Kimura | |
| 2010/0155417 | A1 | 6/2010 | Utzui et al. | |
| 2010/0257305 | A1 | 10/2010 | Asauchi | |
| 2010/0289847 | A1 | 11/2010 | Ishizawa et al. | |
| 2011/0242233 | A1 | 10/2011 | Hirano et al. | |
| 2012/0069068 | A1 | 3/2012 | Ito et al. | |
| 2012/0075392 | A1 | 3/2012 | Shirono et al. | |

FOREIGN PATENT DOCUMENTS

| | | | |
|---|---|---|---|
| EP | 0412459 | A2 | 2/1991 |
| EP | 0440261 | A2 | 8/1991 |
| EP | 0571093 | A2 | 11/1993 |
| EP | 0997297 | A1 | 5/2000 |
| EP | 1153752 | A2 | 11/2001 |
| EP | 1495872 | A2 | 1/2005 |
| EP | 1619030 | A2 | 1/2006 |
| EP | 2080622 | A1 | 7/2009 |
| EP | 2105306 | A2 | 9/2009 |
| EP | 2202078 | A1 | 6/2010 |
| GB | 2312283 | A | 10/1997 |
| JP | H10-044469 | A | 2/1998 |
| JP | 2000-094706 | A | 4/2000 |
| JP | 2002-005724 | A | 1/2002 |
| JP | 2007-196664 | A | 8/2007 |
| JP | 2009-012425 | A | 1/2009 |
| WO | 2011/093527 | A1 | 8/2011 |

OTHER PUBLICATIONS

Japan Patent Office, International Search Report and Written Opinion for International Application No. PCT/JP2011/067819 (counterpart to co-pending U.S. Appl. No. 13/192,180), mailed Aug. 30, 2011.

European Patent Office, European Search Report for European Patent Application No. 11175661.5 (counterpart to co-pending U.S. Appl. No. 13/192,180), dated Dec. 22, 2011.

* cited by examiner

LIQUID CARTRIDGE, IMAGE RECORDING DEVICE, AND SUBSTRATE

CROSS-REFERENCE TO RELATED APPLICATION

This application is a divisional of U.S. patent application Ser. No. 13/192,180, filed on Jul. 27, 2011, the disclosure of which is incorporated herein by reference in its entirety.

BACKGROUND OF THE INVENTION

1. Field of the Invention

The invention relates to a liquid cartridge for storing liquid such as ink, an image recording device comprising the liquid cartridge and a main body, and a substrate configured to be attachable to the liquid cartridge.

2. Description of Related Art

A known ink cartridge detachably attachable to a cartridge installing portion of an inkjet recording device includes an ink pack, a sensor member, a memory device configured to store the ink remaining amount, and a substrate.

SUMMARY OF THE INVENTION

A technical advantage of the invention is that an electric power input terminal for supplying electric power to a sensor or a storage from a main body of a recording device be provided at one position, together with a terminal for sensor and a terminal for memory.

According to one aspect of the invention, a liquid cartridge comprises a liquid reservoir configured to store liquid therein, a liquid flow path configured to selectively allow the liquid reservoir to be in fluid communication with an exterior of the liquid cartridge, a sensor configured to output a signal relative to a position of an object other than the liquid disposed in the liquid flow path, a storage configured to store data therein, and a plurality of terminals. The plurality of terminals comprises a sensor terminal connected to the sensor, a power terminal connected to at least one of the sensor and the storage, and configured to receive power from an exterior of the cartridge, and a data terminal connected to the storage, wherein a distance between at least a first portion of the power terminal and at least a portion of the data terminal is greater than a distance between at least a second portion of the power terminal and at least a portion of the sensor terminal.

According to another aspect of the invention, a liquid cartridge comprises a liquid reservoir configured to store liquid therein, a liquid flow path configured to selectively place the liquid reservoir in fluid communication with an exterior of the liquid cartridge, a sensor configured to detect an object other than the liquid disposed in the liquid flow path, a storage configured to store data therein, a plurality of terminals. The plurality of terminals comprises a sensor terminal connected to the sensor, a power terminal connected to at least one of the sensor and the storage, and configured to supply power from an exterior of the cartridge, and a data terminal connected to the storage. At least a portion of the power terminal is aligned with a particular portion of the sensor terminal in a particular direction, and at least a portion of the data terminal is aligned with a further portion of the sensor terminal in a further direction substantially perpendicular to the particular direction.

According to another aspect of the invention, a liquid cartridge comprises a liquid reservoir configured to store liquid therein, a liquid flow path configured to selectively allow the liquid reservoir to be in fluid communication with an exterior of the liquid cartridge, a sensor configured to output a signal relative to a position of an object other than the liquid disposed in the liquid flow path, a storage configured to store data therein, and a plurality of terminals disposed on a substrate. The plurality of terminals comprises a sensor terminal connected to the sensor, a power terminal connected to at least one of the sensor and the storage, and configured to supply power from an exterior of the cartridge, and a data terminal connected to the storage. Each of the power terminal, data terminal, and sensor terminal are disposed on the substrate in a manner such that at least a portion of the substrate may be divided into a plurality of substantially rectangular areas disposed along a particular direction and a farther direction perpendicular to the particular direction. The plurality of areas comprises a first area, wherein at least a portion of the power terminal is disposed at a central portion of the first area, a second area, wherein the sensor terminal is disposed at a central portion of the second area, and a third area, wherein the data terminal is disposed at a central portion of the third area. The first area and the second area are adjacent in the particular direction, and the first area and third area are not adjacent in the particular direction or the further direction.

According to another aspect of the invention, a liquid cartridge comprises a liquid reservoir configured to store liquid therein, a liquid flow path configured to selectively allow the liquid reservoir to be in fluid communication with an exterior of the liquid cartridge, a sensor configured to output a signal relative to a position of an object other than the liquid disposed in the liquid flow path, a storage configured to store data therein, and a plurality of terminals disposed on a substrate. The plurality of terminals comprises a sensor terminal connected to the sensor, a power terminal connected to at least one of the sensor and the storage, and configured to supply power from an exterior of the cartridge, and a data terminal connected to the storage. Each of the power terminal, data terminal, and sensor terminal are disposed on the substrate in a manner such that at least a portion of the substrate may be divided into a plurality of substantially rectangular areas disposed along a particular direction. The plurality of areas comprises a first area, wherein at least a portion of the power terminal is disposed at a central portion of the first area, a second area, wherein the sensor terminal is disposed at a central portion of the second area, and a third area, wherein the data terminal is disposed at a central portion of the third area. The first area and the second area are adjacent in the particular direction, and the first area and third area are not adjacent in the particular direction.

According to another aspect of the invention, a substrate comprises a first terminal disposed on the substrate and configured to receive a power input, a second terminal disposed on the substrate and configured to receive a sensor output, and a third terminal disposed on the substrate and configured to receive a storage data. A distance between at least a first portion of the power terminal and at least a portion of the data terminal is greater than a distance between at least a second portion of the power terminal and at least a portion of the sensor terminal.

According to another aspect of the invention, an image recording device comprises a liquid cartridge and a main body. The main body comprises a receiving portion configured to removably receive the liquid cartridge, an insertion member, a power supply, a power supplying terminal, a sensor receiving terminal, a storage receiving terminal, and a liquid discharge head configured to be in fluid communication with the liquid cartridge when the liquid cartridge is inserted into the receiving portion. The liquid cartridge comprises a liquid reservoir configured to store the liquid therein, a liquid flow path configured to selectively receive the insertion member, and to selectively allow the main body in fluid communication with the liquid reservoir, a sensor configured to output a signal relative to a position of a movable member disposed in the flow path, a storage configured to store data therein, and a plurality of terminals. The plurality of terminals comprises a sensor terminal connected to the sensor and configured to contact the sensor receiving terminal when the liquid cartridge is inserted into the receiving portion, a data terminal connected to the storage and configured to contact the storage receiving terminal when the liquid cartridge is inserted into the receiving portion, and a power terminal connected to at least one of the sensor sand the storage, and configured to contact the power supplying terminal and to transmit power from the power supply of the main body to the at least one of the sensor and the storage when the liquid cartridge is inserted into the receiving portion. A distance between at least a first portion of the power terminal and at least a portion of the data terminal is greater than a distance between at least a second portion of the power terminal and at least a portion of the sensor terminal.

According to another aspect of the invention, an image recording device, comprises a liquid cartridge and a main body. The main body comprises a receiving portion configured to removably receive the liquid cartridge, an insertion member, a power supply, a power supplying terminal, a sensor receiving terminal, a storage receiving terminal, and a liquid discharge head configured to be in fluid communication with the liquid cartridge when the liquid cartridge is inserted into the receiving portion. The liquid cartridge comprises a liquid reservoir configured to store the liquid therein, a liquid flow path configured to selectively receive the insertion member, and to selectively allow the main body in fluid communication with the liquid reservoir, a sensor configured to output a signal relative to a position of a movable member disposed in the flow path, a storage configured to store data therein, and a plurality of terminals. The plurality of terminals comprises a sensor terminal connected to the sensor and comprising a sensor contact portion, wherein the sensor contact portion is configured to contact a sensor receiving contact portion of the sensor receiving terminal when the liquid cartridge is inserted into the receiving portion, a data terminal connected to the storage comprising a data contact portion, wherein the data contact portion is configured to contact a storage receiving contact portion of the storage receiving terminal when the liquid cartridge is inserted into the receiving portion, and a power terminal connected to at least one of the sensor and the storage, and comprising a power contact portion, wherein the power contact portion is configured to contact a power supplying contact portion of the power supplying terminal, and to transmit power from the power supply of the main body to the at least one of the sensor and the storage when the liquid cartridge is inserted into the receiving portion. A distance between the data contact portion and the power contact portion is greater than a distance between the sensor contact portion and the power contact portion.

Other objects, features, and advantages will be apparent to persons of ordinary skill in the art from the following detailed description of the invention and the accompanying drawings.

DESCRIPTION OF THE DRAWINGS

For a more complete understanding of the present invention, needs satisfied thereby, and the objects, features, and advantages thereof, reference now is made to the following descriptions taken in connection with the accompanying drawing.

DETAILED DESCRIPTION OF EMBODIMENTS OF THE INVENTION

Embodiments of the invention and their features and technical advantages may be understood by referring to FIGS. 1-21, like numerals being used for like corresponding portions in the various drawings.

Figure 1:
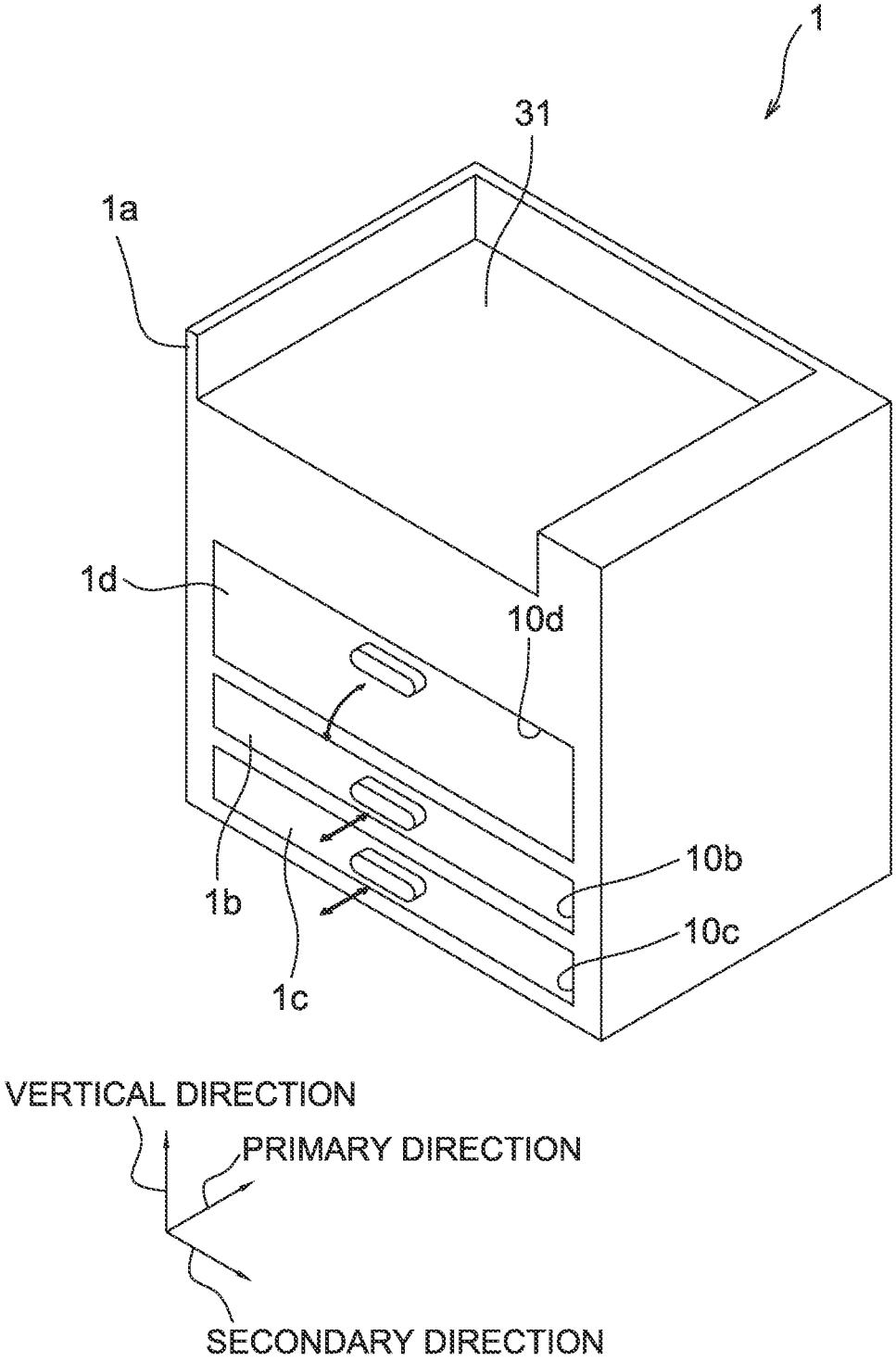
FIG. 1 is a perspective view showing an appearance of an ink jet printer according to an embodiment of the invention.

FIG. 1 describes a general structure of a liquid ejecting device, e.g., an ink jet printer 1, according to an embodiment of the invention. The printer 1 may comprise a main unit and one or more liquid cartridges 40 configured to be mounted to the main unit. The main unit of the printer 1 may comprise a housing 1*a* having substantially a rectangular parallelepiped shape. A sheet discharge portion 31 may be disposed at the top of the housing 1*a*. The housing 1*a* may have three openings 10*d*, 10*b*, and 10*c* formed in one of its vertically extending outer faces, e.g., a front face of the liquid ejecting device. The openings 10*d*, 10*b*, and 10*c* may be vertically aligned in this order from higher to lower when the liquid ejecting device is oriented vertically as shown in FIG. 1.

Figure 2:
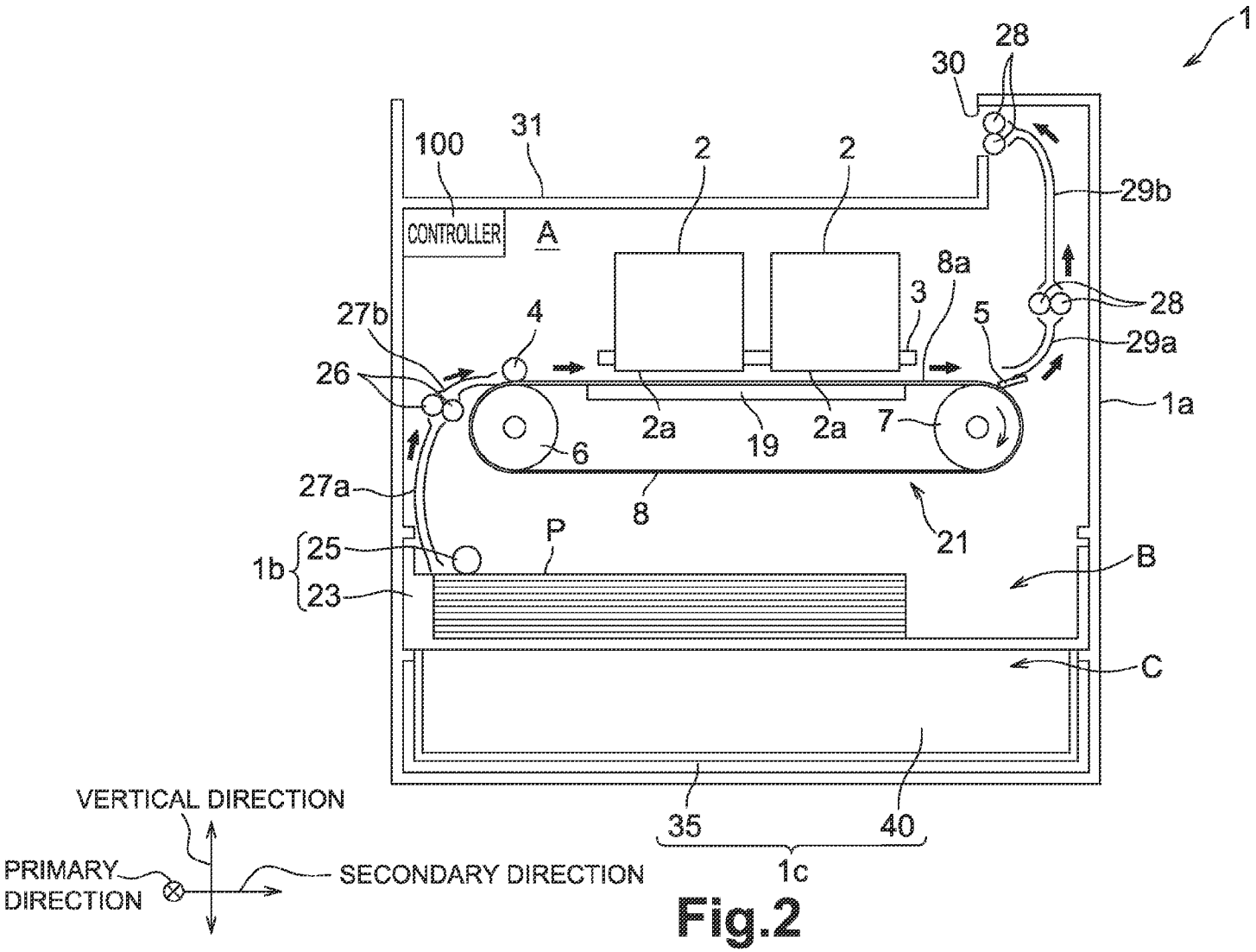
FIG. 2 is a schematic side view showing an internal structure of the printer, according to an embodiment of the invention.

A sheet feed unit 1*b* and an ink unit 1*c* may be removably inserted into the housing 1*a* though the openings 10*b* and 10*c*, respectively. The printer 1 may comprise a door 1*d* fitted into the opening 10*d* and configured to pivot about a horizontal axis at a lower end of door 1*d*. When the door 1*d* is pivoted to be opened and closed, the opening 10*d* is covered and uncovered, respectively. As shown in FIG. 2, the door 1*d* may be disposed with an interior surface facing a transporting unit 21 interior to the liquid ejecting device in a primary direction.

FIG. 2 shows a general interior structure of the printer 1, according to an embodiment of the invention. An interior of the housing 1*a* is divided into spaces A, B, and C in the vertical direction in this order from above to below, as shown in FIG. 2. Two heads 2, the transport unit 21, and a controller 100 are disposed in the space A. The heads 2 are configured to discharge black ink and pretreatment liquid. Hereinafter, the black ink and the pretreatment liquid are collectively referred to as liquid, respectively. In other embodiments of the invention, any suitable liquid may be substituted for the black ink and the pretreatment liquid. The transporting unit 21 may be configured to transport sheets P. The controller 100 may be configured to control operations of the components of the printer 1. The sheet feed unit 1*b* may be disposed in the space B, and the ink unit 1*c* may be disposed in the space C. A sheet transport path, along which sheets P may be transported, may be formed in the housing 1*a*. The sheet transport path may extend from the sheet feed unit 1*b* toward the sheet discharge portion 31, as shown by the bold arrows in FIG. 2.

Figure 4:
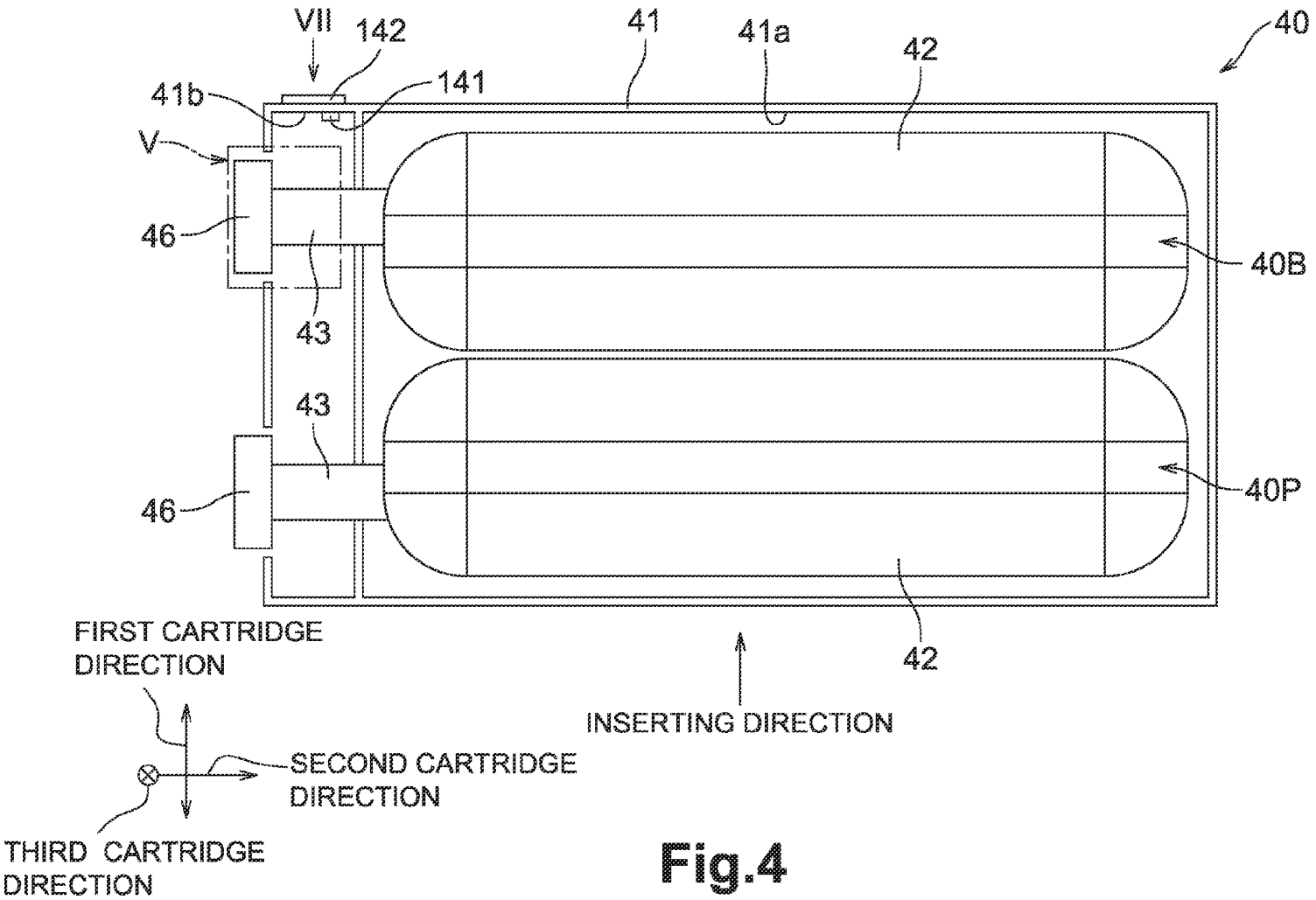
FIG. 4 is a schematic view showing an internal structure of the cartridge of FIG. 3.

The controller 100 may comprise a central processing unit (CPU), a read-only memory (ROM), a random access memory (RAM) such as a nonvolatile RAM, and an interface. The ROM may be configured to store programs to be executed by the CPU and various fixed data. The RAM may be configured to temporarily store data, e.g., image data, necessary for the CPU to execute programs. The controller 100 may be configured to transmit and receive data to and from a memory 141, e.g., as shown in FIG. 4, and Hall devices 71 of a cartridge 40, and transmit and receive data to and from an external device, e.g., a personal computer connected to the printer 1, via the interface.

Figure 9:
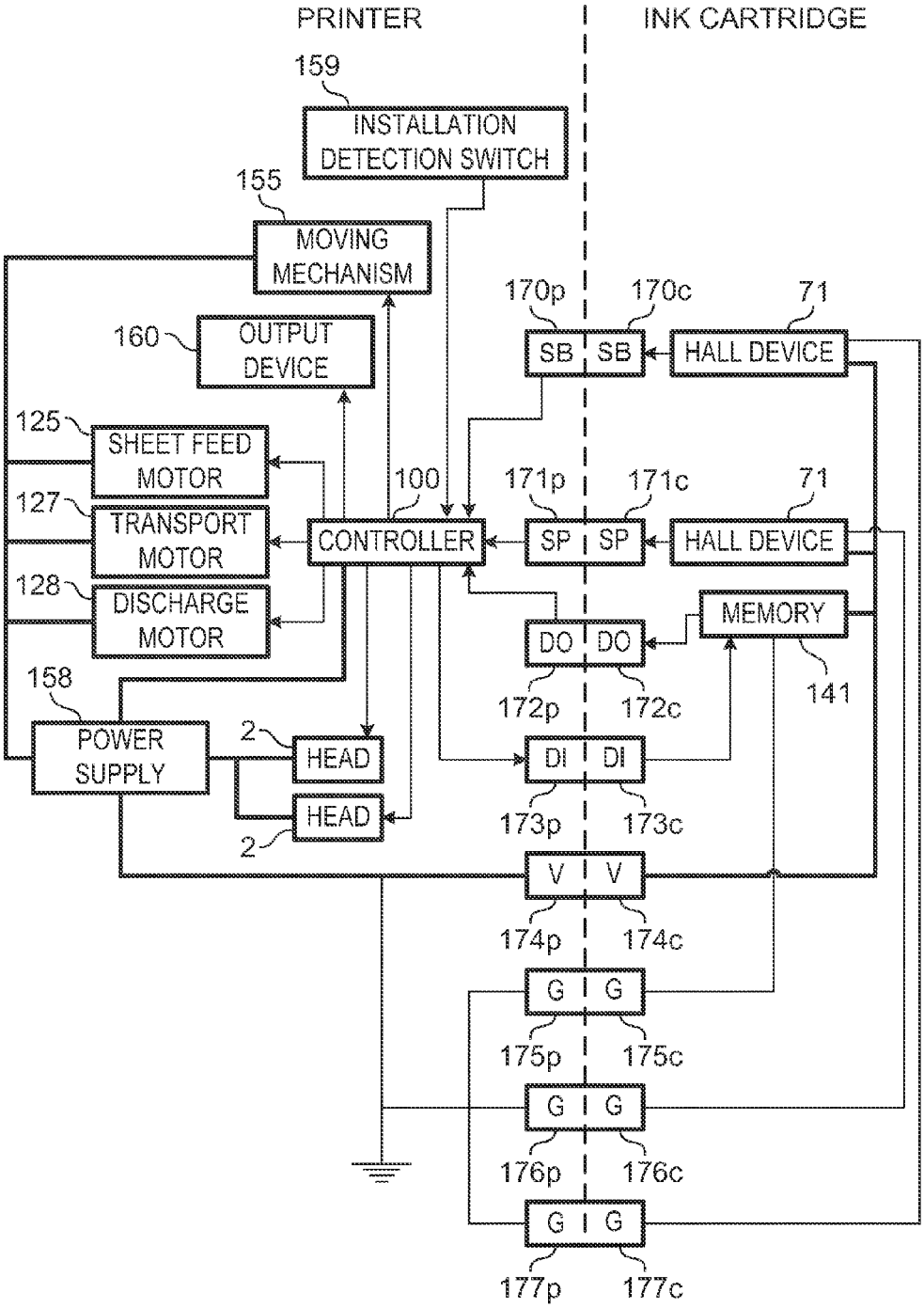
FIG. 9 is a block diagram showing an electrical configuration of the cartridge and the printer.

Referring again to FIG. 2, the sheet feed unit 1*b* may comprise a sheet feed tray 23 and a sheet feed roller 25. The sheet feed tray 23 may be configured to be detachably attached to the housing 1*a* in the primary direction. The sheet fed tray 23 may have a substantially box shape, open upward. Sheet feed tray 23 may be configured to store sheets P of various sizes. As shown in FIG. 9, a sheet feed motor 125 that may be controlled by the controller 100, may drive the sheet feed roller 25, which may be configured to feed out the topmost sheet P in the sheet feed tray when driven by sheet feed roller 25. The sheet P fed out by the sheet feed roller 25 may be sent to the transporting unit 21 while being guided by guides 27*a* and 27*b* and while being nipped by a pair of feed rollers 26.

The transport unit 21 may comprise two belt rollers 6 and 7, and an endless transport belt 8 may be wound around the belt rollers 6 and 7. In an embodiment of the invention, the belt roller 7 may be a driving roller configured to rotate in the clockwise direction when the printer is oriented as shown in FIG. 2. Specifically, referring to FIG. 9, when a shaft of the belt roller 7 is driven by a transport motor 127 controlled by the controller 100, the belt roller 7 may receive a driving force from the transport motor 127. Referring again to FIG. 2, The belt roller 6 may be a driven roller configured to rotate in the clockwise direction when the printer is oriented as shown in FIG. 2, along with the running of the transport belt 8 caused by the rotation of the belt roller 7.

A platen 19 having a substantially rectangular parallelepiped shape may be disposed within the loop of the transport belt 8. An outer surface 8*a* of the transport belt 8 at an upper portion of the loop may face lower surfaces 2*a* of the ink jet heads 2, and may extend substantially in parallel with the lower surfaces 2*a* with a slight gap formed between the lower surfaces 2*a* and the outer surface 8*a*. The platen 19 may support an inner surface of the transport belt 8 at the upper portion of the loop 8. The lower surface 2*a* of each ink jet head 2 may be a discharge surface where a plurality of discharge nozzles for discharging ink may be formed.

A silicone layer having a low adhesive property may be formed on the outer surface 8*a* of the transport belt 8. The sheet P that is fed out from the sheet feed unit 1*b* toward the transport unit 21 may be pressed by a pressing roller 4 against the outer surface 8*a* of the transport belt 8. While being held on the outer surface 8*a* by the adhesive property of outer surface 8*a*, the sheet P may be transported in a secondary direction as shown by the bold arrows in FIG. 2.

The secondary direction is parallel with a transport direction in which the transport unit 21 transports the sheets P. The primary direction is a direction perpendicular to the secondary direction. Each of the primary direction and the secondary direction is a horizontal direction.

The secondary direction may be substantially parallel with a transporting direction in which the transporting unit 21 transports the sheet P. The primary direction is a direction substantially perpendicular to the secondary direction. As shown in FIG. 2, each of the primary direction and the secondary direction is a horizontal direction. When the sheet P held on the outer surface 8*a* of the transport belt 8 passes immediately below the four ink jet heads 2, the ink jet heads 2 discharge inks of respective colors from the lower surfaces 2*a* sequentially, thereby forming an image, e.g., a color image, on the sheet P. A separating plate 5 is configured to separate the sheet P from the outer surface 8*a* of the transport belt 8 when the sheet P is fed to the separating plate 5. The sheet P may be transported upward while being guided by guides 29*a*, 29*b* and while being nipped by two pairs of transport rollers 28, and may be discharged through an opening 30 formed at the top of the housing 1*a* onto the sheet discharge portion 31. Referring to FIG. 9, one roller of each transport roller pair 28 may be driven by a feed motor 128 controlled by the controller 100.

In various embodiments of the invention, the pretreatment liquid one or more has various properties, e.g., a property of improving a density of ink discharged onto the sheet P, a property of preventing the occurrence of ink blurring or strike-through, e.g., the penetration of ink through the sheet P that is being recorded, and a property of improving color reproduction and a quick dry property of ink, and a property of preventing the occurrence of wrinkles or curls on the sheet P after ink is discharged on the sheet P. For example, liquid containing a polyvalent salt, such as cationic high polymer or a magnesium salt, may be used as the pretreatment liquid.

The head 2 for discharging the pretreatment liquid may be disposed upstream from the head 2 for discharging the black ink in the transport direction. Each head 2 may be a line type head elongated in the primary direction and may have a substantially rectangular parallelepiped shape. The heads 2 may be aligned in the secondary direction with a predetermined pitch and are supported by the housing 1*a* via a frame 3. A joint (not shown) is disposed at an upper surface of each head 2 for receiving a flexible tube. Multiple discharge nozzles (not shown) are formed in the lower surface 2*a* of each head 2. A flow path may be formed inside each head 2 such that liquid supplied from a corresponding reservoir 42 of the cartridge 40, via a corresponding tube and a corresponding joint, flows through an exterior of the cartridge 40, and to corresponding discharge nozzles.

The cartridge unit 1*c* may comprise a tray 35, and the cartridge 40 may be configured to be disposed in the tray 35. Referring to FIG. 4, the cartridge 40 may comprise the reservoirs 42, e.g., liquid reservoirs, for storing black ink and pretreatment liquid therein, respectively. The liquid stored in each reservoir 42 of the cartridge 40 may be supplied to the corresponding head 2 via the corresponding flexible tube and the corresponding joint.

The tray 35 may be configured to be detachably attachable to the housing 1*a* in the primary direction in a state where the cartridge 40 is disposed in the tray 35. Accordingly, the cartridge 40 disposed in the tray 35 may be replaced with a new one in a state where the tray 35 is detached from the housing 1*a*.

Figure 3:
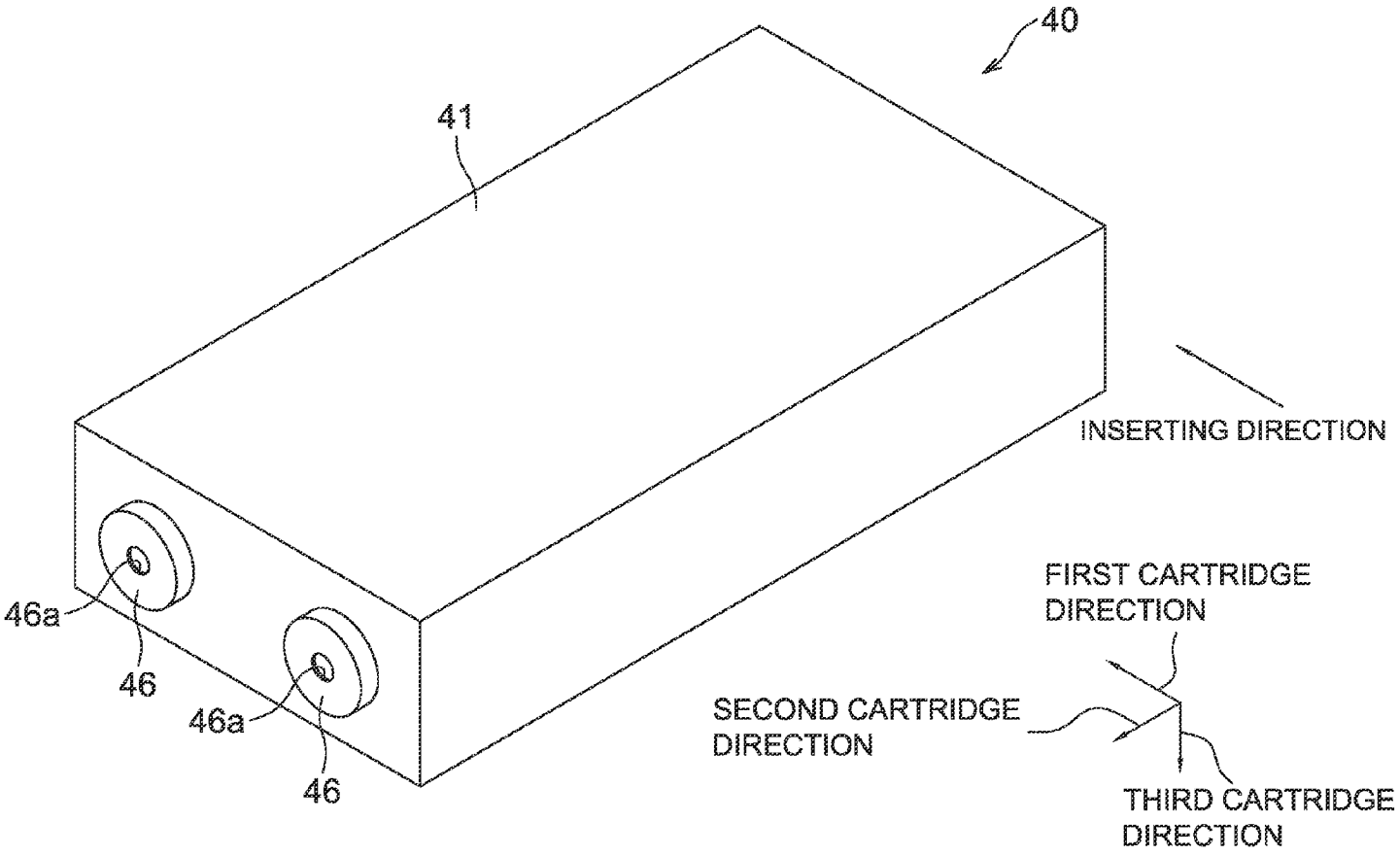
FIG. 3 is a perspective view showing a cartridge according to the first embodiment of the invention.

FIGS. 3-7 show a structure of the cartridge 40 according to an embodiment of the invention. As shown in FIGS. 3 and 4, the cartridge 40 may comprise a housing 41, a black ink unit 40B, a pretreatment liquid unit 40P, a memory 141, and a substrate 142. Each of the black ink unit 40B and the pretreatment liquid unit 40P may comprise the reservoir 42, an ink outlet tube 43, a plug 50, a valve 60, and a sensor unit 70. The black ink unit 40B and the pretreatment liquid unit 40P have substantially the same structure, as shown in FIG. 5.

As shown in FIG. 3, the housing 41 has a substantially rectangular parallelepiped shape. As shown in FIG. 4, the interior of the housing 41 is divided into two chambers 41*a* and 41*b*. The black ink unit 40B and the pretreatment liquid unit 40P may be disposed in the chamber 41*a*. The ink outlet tubes 43 of the black ink unit 40B and the pretreatment liquid unit 40P may be disposed in the chamber 41*b*. Each reservoir 42 may comprise a bag for storing liquid therein and may have an opening to which one end of the ink outlet tube 43 is connected. The reservoir 42 of the black ink unit 40B may be configured to store black ink therein. Similarly, the reservoir 42 of the pretreatment liquid unit 40P may be configured to store pretreatment liquid therein.

Figure 5A:
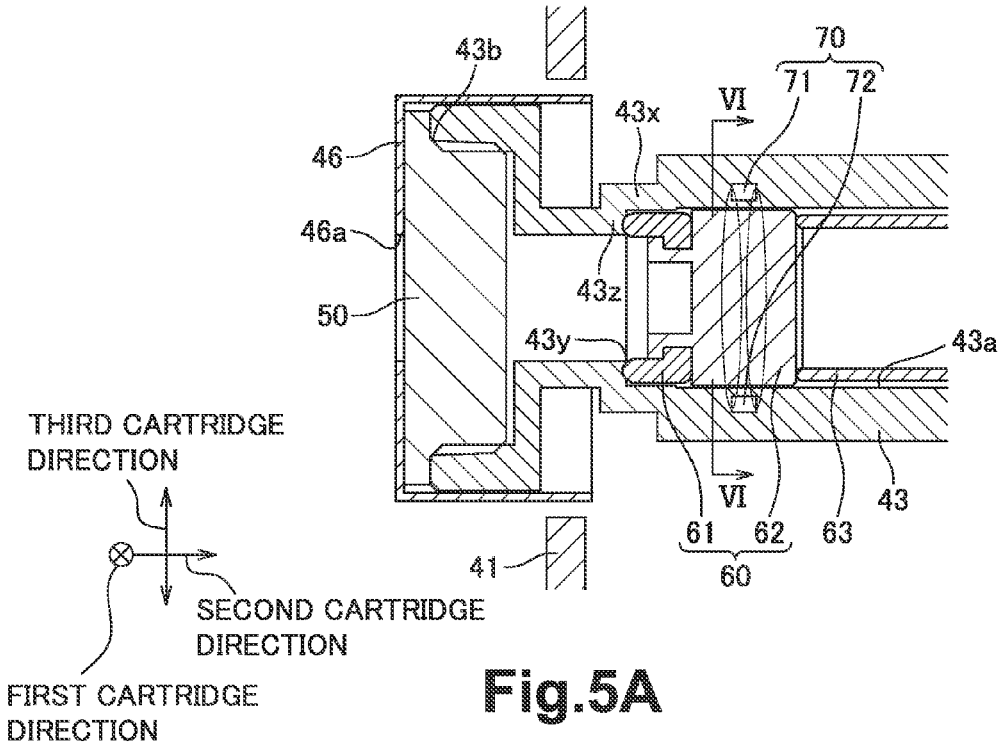
FIG. 5A is a partial sectional view of an area designated by arrow V in FIG. 4, in which a hollow tube of the printer is not inserted into a plug of the cartridge and a valve of the cartridge is in a closed position.

Referring to FIG. 5A, the ink outlet tube 43 may define an ink outlet path 43*a* for discharging the liquid stored in the reservoir 42 to the head 2. As shown in FIG. 4, the other end of the ink outlet tube 43 may protrude from the housing 41 of the cartridge 40. The ink outlet tube 43 may have an opening 43*b* at a side opposite to the reservoir 42. A plug 50 may comprise an elastic material, e.g., rubber, is disposed in a compressed state at the other end of the ink outlet tube 43 such that the plug 50 closes the opening 43*b* of the ink outlet path 43*a*, e.g., as shown in FIG. 5A. A cap 46 may be disposed at the other end of the ink outlet tube 43 and outside the plug 50. The cap 46 may have an opening 46*a* formed therethrough substantially in its center. A surface, which is an opposite side of a surface facing the valve 60, of the plug 50 may be partially exposed through the opening 46*a*.

As shown in FIG. 5A, the valve 60 is disposed in the ink outlet path 43*a* and comprises an O-ring 61 and a valve body 62. As shown in FIGS. 5A to 6, the valve body 62 may be a cylindrical-shaped magnetic body having an axis extending in a second cartridge direction. When the liquid cartridge 40 is mounted in the liquid cartridge tray 35 of the printer 1, the first cartridge dimension is aligned with the primary direction, the second cartridge direction is aligned with the secondary direction, and the third cartridge direction is aligned with the vertical direction.

As shown in FIG. 6, the ink outlet tube 43 may have a substantially cylindrical-shape. The valve body 62 may be disposed at a portion in the ink outlet tube 43. The portion of the ink outlet tube 43 may comprise flat top and bottom walls and curved side walls, and may be elongated in the first cartridge direction in cross section which extends in a direction perpendicular to the second cartridge direction. Protrusions 43*p* may be disposed at inner surfaces of the respective side walls of the ink outlet tube 43 in the first cartridge direction, such that protrusions 43*p* may protrude toward the inside of the ink outlet tube 43. Each protrusion 43*p* may extend along the second cartridge direction within an area in which the valve body 62 is movable. The valve body 62 may be held in place by the protrusions 43*p* and the top and bottom walls of the ink outlet tube 43 such that the valve body 62 is positioned substantially at the center of the ink outlet path 43*a* when viewed in cross-section, even when valve body 62 is moved. A flow path may be formed by the valve body 62 and the ink outlet tube 43 at a portion where the valve body 62, the protrusions 43*p* and the top and bottom walls of the ink outlet tube 43 do not contact with each other.

The O-ring 61 may comprise an elastic material, e.g., rubber. The O-ring 61 may be fixed to a surface that faces plug 50 of the valve body 62. The valve 60 may be pressed toward an opening 43*y* of a narrowed portion 43*x* of the ink outlet path 43 by a coil spring 63. The coil spring 63 may be fixed, at its one end, to the one end of the ink outlet tube 43, and at its other end, is in contact with the other surface of the valve body 62.

As shown in FIG. 5A, the ink outlet tube 43 may comprise a valve seat 43*z* that protrudes toward the center of the diameter of the ink outlet tube 43 from one end, e.g., an end disposed near the opening 43*b*, of the narrowed portion 43*x*. When the valve 60 is in a closed position, at which the valve 60 closes the ink outlet path 43*a*, the O-ring 61 may be in contact with the valve seat 43*z* to seal the opening 43*y* at the one end of the narrowed portion 43*x* of the ink outlet tube 43. Thus, fluid communication between the reservoir 42 and the outside of the reservoir 42 via the ink outlet path 43*a* may be prevented. In this state, the O-ring 61 may be elastically deformed by the biasing force of the coil spring 63.

The sensor unit 70 may comprise the Hall device 71 and a magnet 72. The magnet 72 may produce a magnetic field, and Hall device 71 may be a magnetic sensor that detects a magnetic field of the magnet 72, converts the detected magnetic field to an electric signal, and generates the electric signal. In an embodiment, the Hall device 71 generates a signal that indicates a voltage proportioned to the magnetic field magnitude. The magnetic field magnitude varies in accordance with the movement of the valve body 62, e.g., a based on a position of the valve body 62. As shown in FIG. 5A, the Hall device 71 may be disposed at a position where the Hall device 71 is capable of detecting the magnetic field produced by the magnet 72 and the valve body 62. The Hall device 71 and the magnet 72 may be fixed to the top wall and the bottom wall, respectively, so as to face each other in the third cartridge direction.

When the valve 60 is in the closed position, the Hall device 71 and the magnet 72 face each other while the valve body 62 is positioned therebetween, i.e., the valve body 62 may be interposed between the Hall device 71 and the magnet 72. In this state, the magnetic field produced by the magnet 72 efficiently reaches the Hall device 71 via the valve body 62. Accordingly, the Hall device 71 detects a high magnetic field magnitude and generates a signal indicating a high voltage. When the valve 60 moves from the closed position, e.g., the position shown in FIG. 5A, to an open position, e.g., the position shown in FIG. 5B, at which the valve 60 opens the ink outlet path 43*a*, the magnetic field magnitude detected by the Hall device 71 may decrease in accordance with the movement of the valve body 62, to the position where the valve body 62 does not face the Hall device 71 and the magnet 72 in the vertical direction, i.e., the valve body 62 is not positioned between the Hall device 71 and the magnet 72. Thus, the voltage indicated by a signal generated by the Hall device 71 may become lower. The controller 100 may receive the signal generated by the Hall device 71 and may determine whether the valve 60 is in the closed position or in the open position based on a voltage indicated by the signal generated by the Hall device 71.

The substrate 142 may be provided at an outer surface of a downstream wall of the housing 41 of the cartridge 40 in a direction that the cartridge 40 is inserted into the space C, hereinafter interchangeably referred to as an inserting direction. The inserting direction may be parallel with the first cartridge direction of the cartridge 40. The memory 141 may be provided opposite to the substrate 142. The memory 141 comprises an electrically erasable programmable ROM (EEPROM) or the like and may store data relating to the cartridge 40. More specifically, the memory 141 may prestore a liquid reservoir capacity, e.g., an amount of liquid stored in each reservoir 42 of a brand-new cartridge 40, sensor output values, e.g., output values Vmax and Vmin received from each Hall device 71 (referring to FIG. 12), a manufacture date. e.g., a year, month, and day of manufacture of a cartridge 40. The controller 100 may read those data from the memory 141 while the cartridge 40 is installed in the printer 1. In addition, while the cartridge 40 is installed in the printer 1, the controller 100 may write various data in the memory 141, e.g., a liquid usage amount that may correspond to an amount of liquid that has been used in each reservoir 42, i.e., an amount of liquid that has been discharged from each head 2, the number of hollow tube insertions that may correspond to the number of times the hollow tubes 153 have been inserted into the respective plugs 50, the number of recorded sheets that may correspond to the number of sheets P which have been recorded by using the liquid stored in the cartridge 40, and a cumulative usage time that may correspond to a total period of time during which the cartridge 40 is installed in the printer 1, which is the same as a total period of time during which the hollow tubes 153 are inserted into the respective ink outlet path 43*a*. The controller 100 may read those written data stored in the memory 141 while the cartridge 40 is installed in the printer 1.

Figure 7:
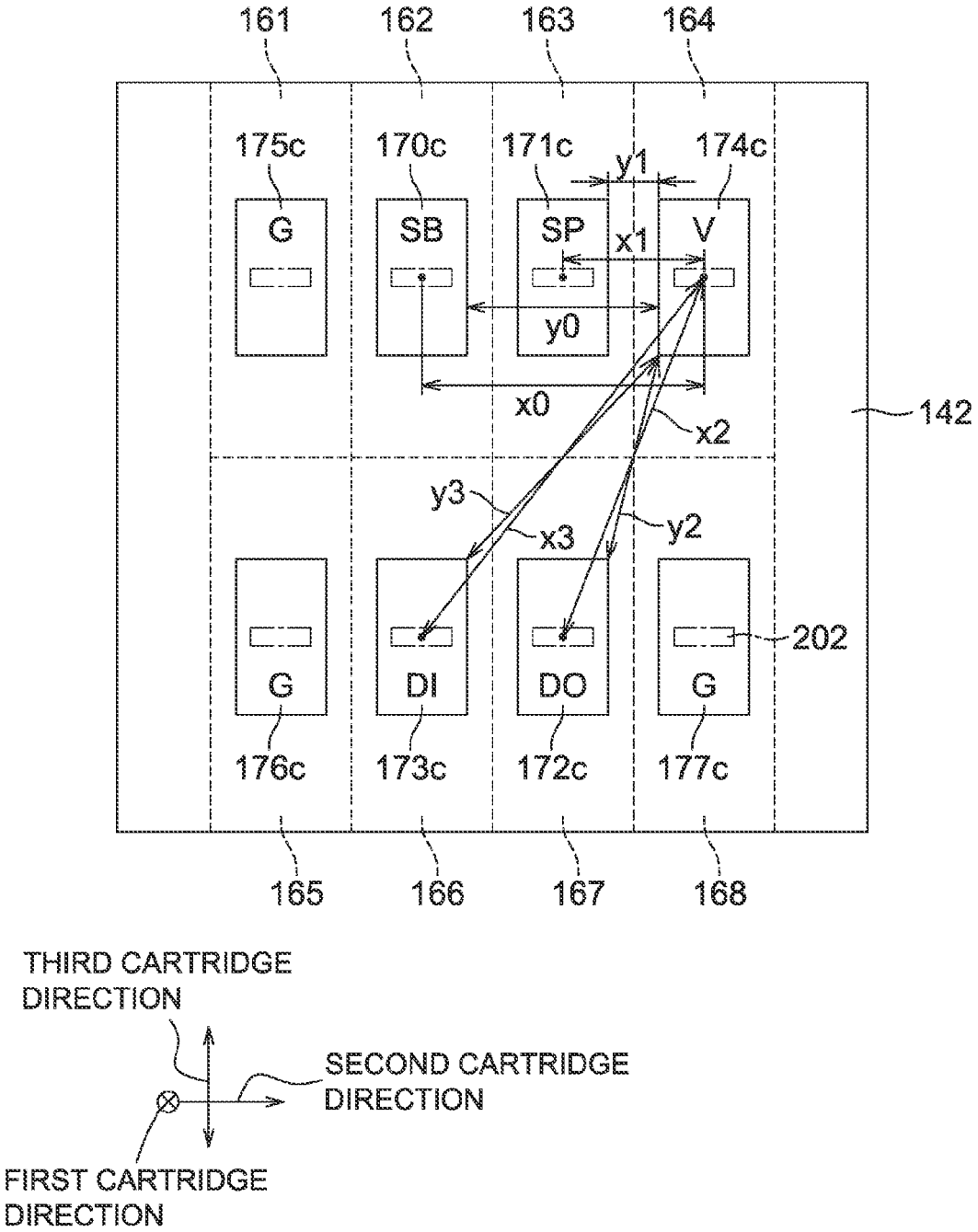
FIG. 7 is a drawing showing terminals of the cartridge according to the first embodiment of the invention, and viewed in the direction of the appended arrow VII in FIG. 4.

As shown in FIG. 7, eight terminals 170*c* to 177*c* may be provided on a surface of the substrate 142. The terminals 170*c* to 177*c* may have substantially the same size and shape and may be exposed at the outer surface of the cartridge 40. A shape of each of the terminals 170*c* to 177*c* may be substantially rectangular including two shorter sides extending in a direction parallel to the second cartridge direction and two longer sides extending in a direction parallel to the third cartridge direction. The terminals 170*c* to 177*c* may be arranged in a plurality of, e.g., two, rows.

In an embodiment of the invention, when two or more terminals are described as aligned, a line may be drawn that contacts at least a portion of each of the two or more terminals in the specified direction. For example, four of the terminals, e.g., terminals 174*c*, 171*c*, 170*c*, and 175*c* may be aligned in the second cartridge direction. Similarly, four of the terminals, e.g., terminals 176*c*, 173*c*, 172*c*, and 177*c* also may be aligned in the second cartridge direction. Further, terminals 172*c* and 171*c* may be aligned in the third cartridge direction, but terminals 172*c* and 174*c* are not aligned in the third cartridge direction.

In an embodiment of the invention, each of terminals 170*c* to 177*c* may have a center portion. In an embodiment of the invention, this center portion may be defined as a portion that includes the center of gravity of the terminal. In other embodiments of the invention, the center portion may be defined as a portion that includes the portion that is halfway between the furthest points in the second cartridge direction and third cartridge direction. In still other embodiments of the invention, the center portion of the terminal may be defined as a middle portion of the part of the terminal having the greatest length and width. In yet other embodiments of the invention, the center portion of the terminal may be a contact portion, i.e., a portion that contacts a respective corresponding terminal of the liquid ejection device In an embodiment of the invention, each distance between centers of the terminal 174*c* and a respective one of the terminals 170*c* to 173*c* is x0, x1, x2, and x3 and each shortest distance between edges of the terminal 174*c* and a respective one of the terminals 170*c* to 173*c* is y0, y1, y2, and y3. In an embodiment of the invention, the terminals 170*c* to 174*c* are arranged on the substrate 142 such that their positional relationship satisfies $x1<x0<x2<x3$ and $y1<y0<y2<y3$. In an embodiment of the invention, as shown in FIG. 7, xn (n=0, 1, 2, or 3) represents a distance between centers of terminals 174*c* and 17*nc*, and yn (n=0, 1, 2, or 3) represents a shortest distance between edges of terminals 174*c* and 17*nc*.

In an embodiment of the invention, terminal 174*c* may be configured to receive power from an exterior of the cartridge, e.g., from an electric power output terminal (V) 174*p*, as will be described in more detail herein. As shown in FIG. 9, the sensor signal output terminal (SB) 170*c* may be electrically connected with the Hall sensor 71 of the black ink unit 40B. The sensor signal output terminal (SP) 171*c* may be electrically connected with the Hall sensor 71 of the pretreatment liquid unit 40P. The data output terminal (DO) 172*c* and the data input terminal (DI) 173*c* may be electrically connected to the memory 141. The ground terminals (G) 175*c* , 176*c*, 177*c* may be electrically connected with the memory 141, the Hall device 71 of the pretreatment liquid unit 40P, and the Hall device 71 of the black ink unit 40B, respectively.

Any continuous segment of the terminals 170*c* to 177*c* may be a portion. In an embodiment of the invention, the portions of the data terminal may be center portions, i.e., including the centers of the respective terminal. In other embodiments, however, the portions may have any shape, including geometric and non-geometric shapes, and may or may not include the center of the respective terminal. In still other embodiments, an edge of the terminal may be a portion of the terminal.

Figure 8A:
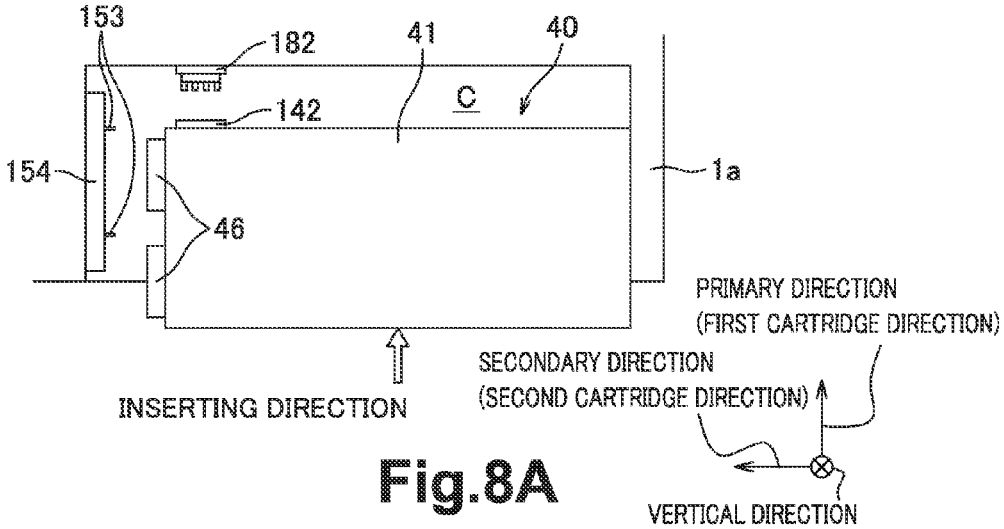
FIGS. 8A to 8C are schematic plan views showing a process of installing the cartridge to the printer.
Figure 8B:
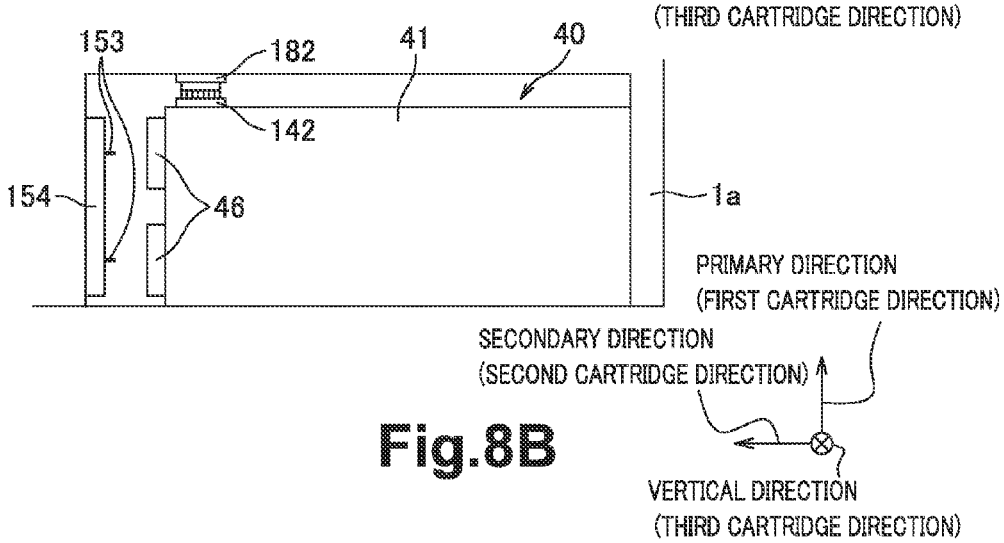
Figure 8C:
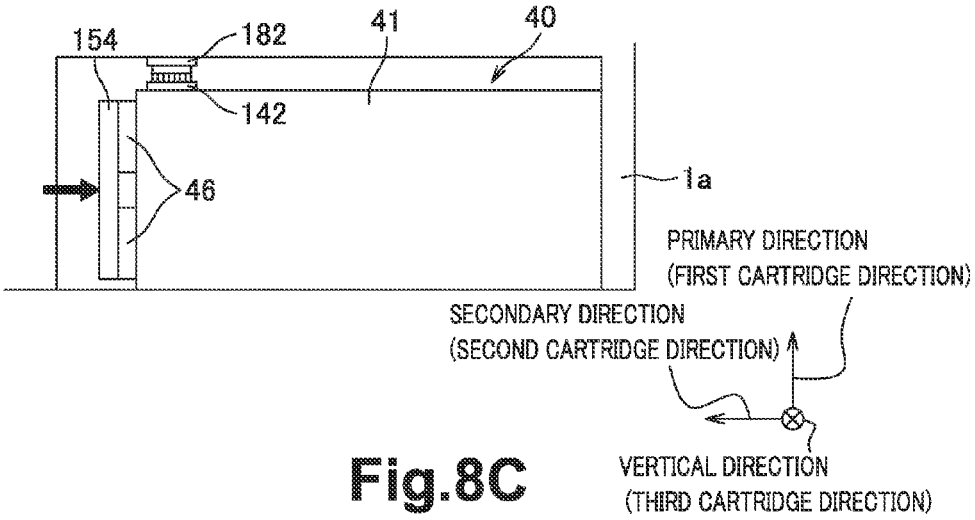
Figure 18:
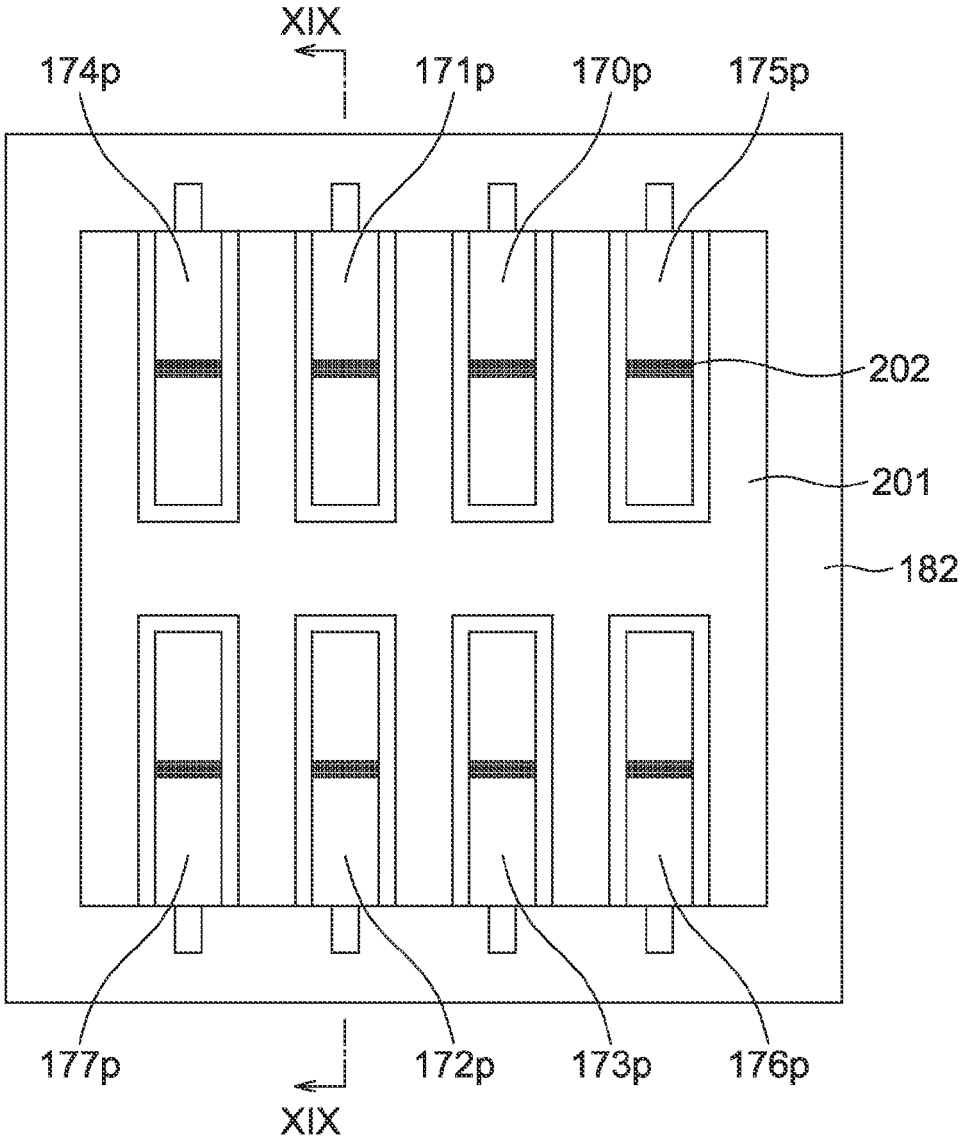
FIG. 18 is a drawing showing terminals of the printer according to an embodiment of the invention, and viewed in an inserting direction of FIG. 8A.
Figure 19:
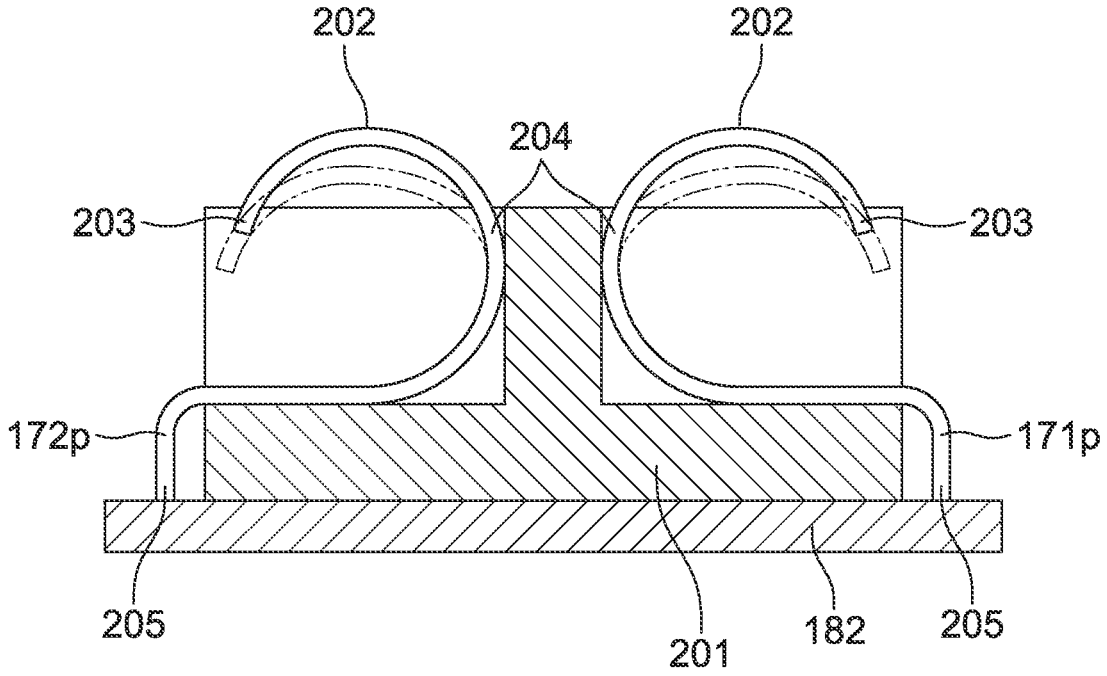
FIG. 19 is a partial sectional view taken along a line XIX-XIX in FIG. 18.

A substrate 182 may be provided on a surface of the wall that extends in a direction perpendicular to the inserting direction and, as shown in FIG. 8A, may be one of the walls defining the space C in the housing 1*a* of the printer 1. The substrate 182 has substantially the same size as the substrate 142. The substrate 182 may be disposed to face the substrate 142 of the cartridge 40 when the cartridge 40 is installed in a predetermined position, as shown in FIG. 8B, in the space C. A base material 201 may be disposed on a surface of the substrate 182, as shown in FIGS. 18 and 19. Eight terminals 170*p* to 177*p* may be provided on a surface of the base material 201 such that the terminals 170*p* to 177*p* correspond to the terminals 170*c* to 170*c*, respectively.

As shown in FIG. 19, each of the terminals 170*p* to 177*p* may comprise a leaf spring having a substantially C-shape in cross section, and may have a first end 205, a second end 203, and a top portion 202. In each of the terminals 170*p* to 177*p*, the first end 205 is a fixed end that is fixed to the substrate 182 to establish electric connections therebetween and the second end 203 is a free end that can bend at a portion 204. The second end 203 may be urged in the primary direction and in a direction that the second end 203 approaches the terminals 170*c* to 177*c* of the cartridge 40 installed in the predetermined position in the space C.

The terminals 170*p* to 177*p* are arranged in a mirror image of the terminals 170*c* to 177*c* such that the terminals 170*p* to 177*p* make contact with the terminals 170*c* to 177*c*, respectively, when the cartridge 40 is installed in the predetermined position in the space C. Specifically, the terminals 170*p* to 177*p* are arranged such that their top portions 202 make contact with the centers of the terminals 170*c* to 177*c*, respectively, when the cartridge 40 is installed in the predetermined position in the space C. As shown in FIG. 9, the sensor signal receiving terminal (SB) 170*p*, the sensor signal receiving terminal (SP) 171*p*, the data receiving terminal (DO) 172*p*, and the data transmitting terminal (DI) 173*p* may be electrically connected with the controller 100. The electric power output terminal (V) 174*p* may be electrically connected with a power supply 158 provided in the housing 1*a*. The ground terminals 175*p*, 176*p*, 177*p* may be grounded.

A process of installing the cartridge 40 into the printer 1 will be described with reference to FIGS. 5A to 12, 18 and 19. The tray 35 is not illustrated in FIGS. 8A to 8C for sake of simplicity. In FIG. 9, electric power supply lines are shown by thick lines and signal lines are shown by thin lines. While the cartridge 40 is separated from the printer 1, hollow tubes 153 of the printer 1 may be not inserted into the respective plugs 50 of the black ink unit 40B and the pretreatment liquid unit 40P. Therefore, the valves 60 may be held at the open positions, e.g., as shown in FIG. 5A. In this state, electric connections between the terminals 170*c* to 177*c* and the corresponding terminals 170*p* to 177*p* are not established. Thus, the electric power is not supplied to the Hall devices 71 or the memory 141, and the controller 100 is not capable of performing signal transmission and reception with the Hall devices 71 and the memory 141.

For installation of the cartridge 40 into the printer 1, the cartridge 40 may be placed in the tray 35 first, as shown in FIG. 2, and the tray 35 may be inserted into the space C of the housing 1*a* in the primary direction, e.g., in a direction shown by an open arrow in FIG. 8A such that the terminals 170*c* to 177*c* of the cartridge 40 are in contact with the corresponding terminals 170*p* to 177*p* of the housing 1*a*, as shown in FIG. 8B.

In the state shown in FIG. 8B, the centers of the terminals 170*c* to 177*c* are in contact with the top portions 202 of the corresponding terminals 170*p* to 177*p*, which may establish electric connections therebetween. Thus, the electric power may be supplied from the power supply 158 to the Hall devices 71 and the memory 141 via the terminals 174*p* and 174*c*. Further, the controller 100 becomes capable of receiving signals from the Hall device 71 of the black ink unit 40B via the terminals 170*c* and 170*p*, receiving signals from the Hall device 71 of the pretreatment liquid unit 40P via the terminals 171*c* and 171*p*, reading data from the memory 141 via the terminals 172*c* and 172*p*, and writing data into the memory 141 via the terminals 173*c* and 173*p*.

In a process of installing the cartridge 40 into the printer 1, first, the centers of the terminals 170*c* to 177*c* contact the top portions 202 of the corresponding terminals 170*p* to 177*p* immediately before the cartridge 40 is completely installed in the printer 1. Then, until the cartridge 40 is completely installed in the printer 1, the terminals 170*c* to 177*c* press the corresponding terminals 170*p* to 177*p* to change states of the terminals 170*p* to 177*p* from a state shown in a solid line to a state shown in a dashed line as shown in FIG. 19. That is, the terminals 170*p* to 177*p* may bend at their portions 204 in the primary direction and in a direction that the second ends 203 distance from the terminals 170*c* to 177*c* of the cartridge 40 installed in the predetermined position in the space C.

The terminals 170*c* to 177*c* have contact portions (shown by dot and dashed lines in FIG. 7), respectively, to which the top portions 202 of the corresponding terminals 170*p* to 177*p* contact after the cartridge 40 is completely installed in the printer 1. The contact portions may include the centers of the terminals 170*c* to 177*c*, respectively. The contact portions in the terminals 175*c*, 170*c* 171*c*, 174*c* arranged in the top row may gradually shift upward in the vertical direction from a position slightly below the contact portions shown in FIG. 7 and the contact portions in the terminals 176*c*, 173*c*, 172*c*, 177*c* arranged in the bottom row may gradually shift downward in the vertical direction from a position slightly above the contact areas shown in FIG. 7 in a period of time from immediately before and until after the cartridge 40 is completely installed in the printer 1.

A support member 154 may be provided to a wall, which extends in the direction perpendicular to the secondary direction, faces the caps 46 of the cartridge 40 when the cartridge 40 is installed in the predetermined position in the space C, and is one of the walls defining the space C of the housing 1*a*. The support member 154 is configured to be movable in the secondary direction with respect to the housing 1*a* while supporting the hollow tubes 153. The hollow tubes 153 correspond to the head 2 for discharging the black ink and the head 2 for discharging the pretreatment liquid, respectively. The hollow tubes 153 may be in fluid communication with the respective flexible tubes attached to the joints of the corresponding heads 2.

In the state shown in FIG. 8B, the cartridge 40 may be separated from the hollow tubes 152 so that the reservoirs 42 are not in fluid communication with the corresponding flow paths of the corresponding heads 2. The printer 1 may comprise an installation detection switch 159 that is configured to detect an installation of the cartridge 40 in the predetermined position in the space C, as shown in FIG. 9.

The installation detection switch 159 may comprise a protrusion at the wall that extends in the direction perpendicular to the inserting direction and is one of the walls defining the space C of the housing 1*a*. The protrusion may be disposed near the substrate 182, for example. Before the cartridge 40 is installed into the space C, the protrusion protrudes from the wall. When the cartridge 40 is inserted into the space C and is placed at the position shown in FIG. 8B, the protrusion may retract in the wall by the pressing of the housing 41 of the cartridge 40. The installation detection switch 159 is configured to output OFF signals when the protrusion protrudes from the wall and ON signals when the protrusion retracts in the wall.

Figure 11:
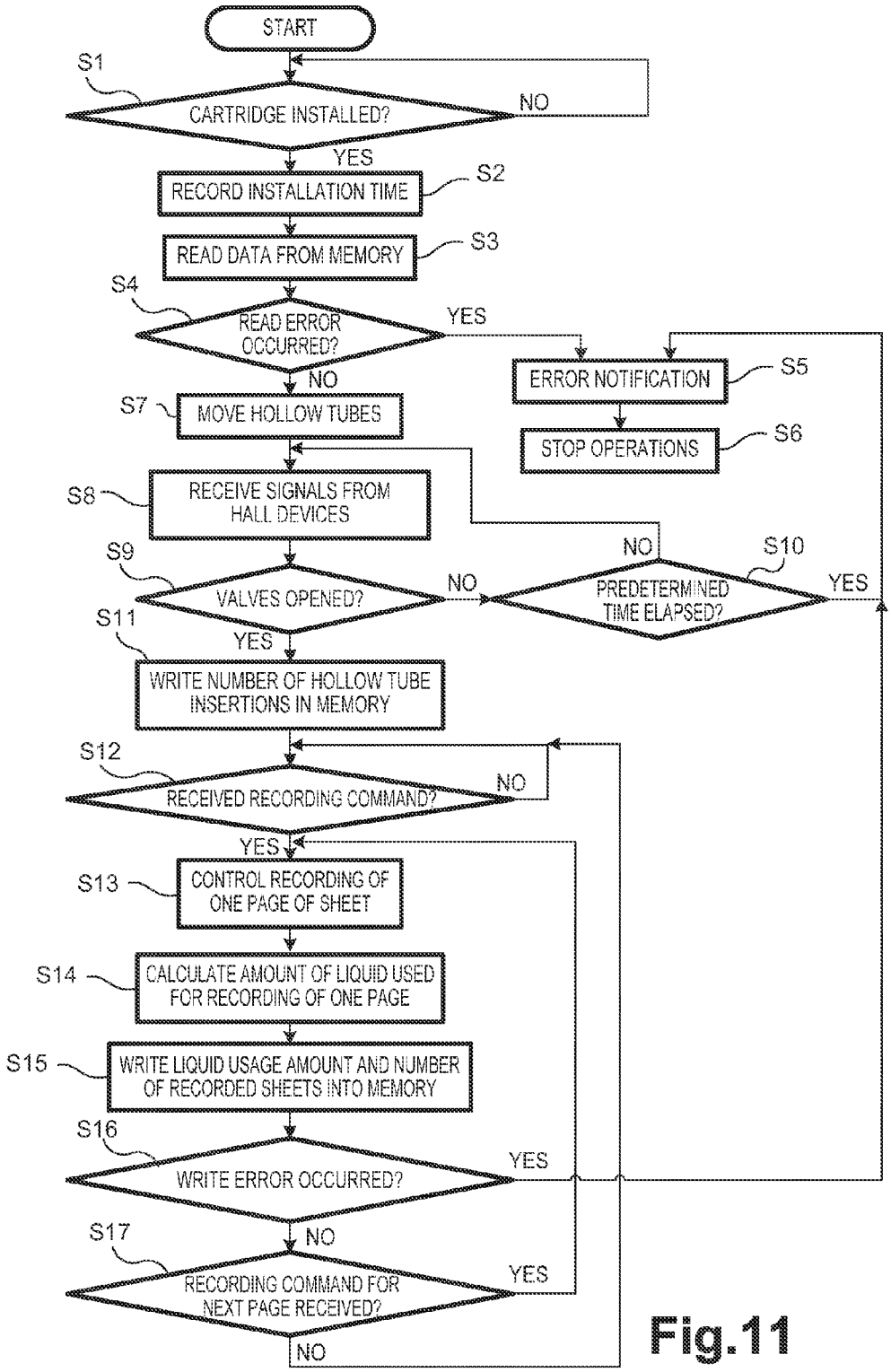
FIG. 11 is a flowchart showing control executed by the controller of the printer while the cartridge is installed in the printer, according to an embodiment of the invention.

Referring to FIG. 11, at Step S1, the controller 100 may determine whether the cartridge 40 has been installed in the predetermined position in the space C, based on a signal received from the installation detection switch 159. When the controller 100 detects that the cartridge 40 has been installed in the predetermined position in the space C by the receipt of an ON signal from the installation detection switch 159, e.g., "YES" at Step S1, then at Step S2, controller 100 records the time at which the cartridge 40 is installed in the predetermined position (the installation time) and at Step S3, controller 100 reads, from the memory 141 of the cartridge 40, the data of the liquid reservoir capacity, the sensor output values, the manufacture date, the liquid usage amount, the number of hollow tube insertions, the number of recorded sheets, and the cumulative usage time).

After Step S3, at Step S4, the controller 100 determines whether a read error has occurred. When the controller 100 could not perform a reading procedure normally, the controller 100 determines that a read error has occurred, e.g., "YES" at Step S4, and at Step S5, notifies the error via an output device 160, e.g., a display or a speaker of the printer 1 shown in FIG. 9. After Step S5, the controller 100 stops operations of each component of the printer 1 at Step S6.

The read error may occur due to damage to the memory 141 caused by a short circuit occurred between the terminal 172*c* the terminal 174*c* or due to a malfunction in communications capabilities of the controller 100 caused by a short circuit occurred between the terminal 173*c* and the terminal 174*c*. When the controller 100 could not perform a reading procedure normally in S4, the controller 100 determines that a read error has not occurred, e.g., "NO" at Step S4. At Step S7, the controller 100 then controls a moving mechanism 155, shown in FIG. 9, to move the support member 154 holding the hollow tubes 153 in the secondary direction, indicated by a thick arrow in FIG. 8C.

Figure 5B:
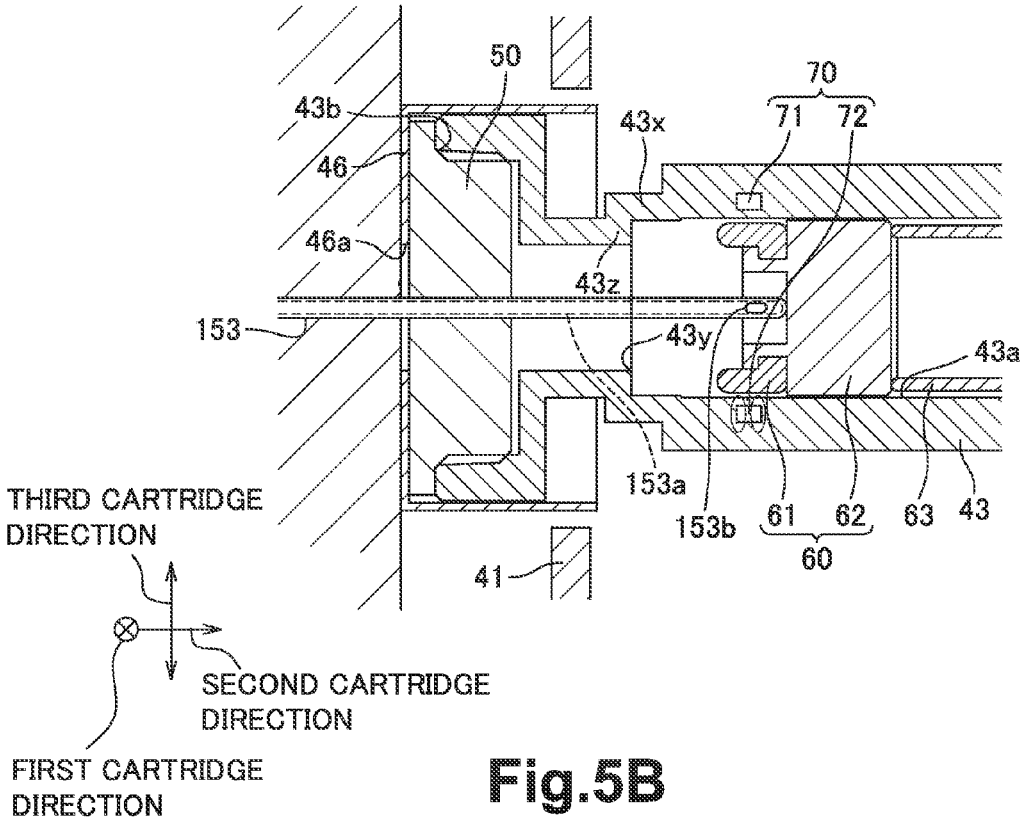
FIG. 5B is a partial section view of the area designated by arrow V in FIG. 4, in which the hollow tube of the printer is inserted into the plug of the cartridge and the valve of the cartridge is in an open position.
Figure 6:
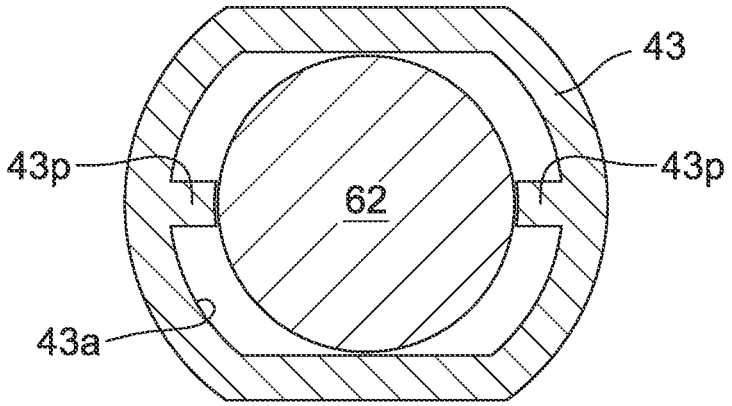
FIG. 6 is a partial sectional view taken along a line VI-VI in FIG. 5A.

In accordance with the movement of the hollow tubes 153 in Step S7, the hollow tubes 153 penetrate the substantially centers of the respective plugs 50 via the openings 46*a* in the primary direction as shown in FIG. 5B. Each hollow tube 153 may have an opening 153*b* formed therethrough at its one end. Therefore, in this state, the opening 153*b* may be positioned in the ink outlet path 43*b*, so that a flow path 153*a* provided in the hollow tube 153 and the ink outlet path 43*a* are in fluid communication with each other via the opening 153*b*. The plug 50 may be perforated with a hole by the penetration of the hollow tube 153. A portion surrounding the hole of the plug 50 intimately contacts the circumference of the hollow tube 153 by the elasticity of the plug 50. Therefore, leakage of liquid from a gap between the hole of the plug 50 and the hollow tube 153 may be reduced or prevented.

Then, a tip of the hollow tube 153 may contact the valve body 62, and the valve body 62 may move together with the O-ring 61 by the further insertion of hollow tube 153 into the ink outlet path 43*a*. Thus, the O-ring 61 is separated from the valve seat 43*z*, e.g., as shown in FIG. 5B, and the valve 60 may transition to the open position from the closed position.

When the valve 60 is in the open position, the ink outlet path 43*a* may place the reservoir 42 and the outside of the reservoir 42 in fluid communication. That is, as shown in FIG. 5B, when the hollow tube 153 penetrates the plug 50 and the valve 60 is in the open position, the reservoir 42 and the flow path of the head 2 may be in fluid communication with each other via the ink outlet path 43*a* and the flow path 153*a*.

After Step S7, at Step S8, the controller 100 receives signals from the Hall devices 71 of the black ink unit 40B and the pretreatment liquid unit 40P. After Step S8, then in Step S9, the controller 100 determines whether the valves 60 of the black ink unit 40B and the pretreatment liquid unit 40P are in the open positions, i.e., the reservoirs 42 and the corresponding heads 2 are in fluid communication with each other and the liquid is allowed to flow from the reservoirs 42 to the corresponding heads 2 via the corresponding hollow tubes 153, based on the signals received in Step S8 and the output values Vmax and Vmin read from the memory 141 in Step S3. The determination in Step S9 is made in a manner described below with reference to FIG. 12.

Figure 12:
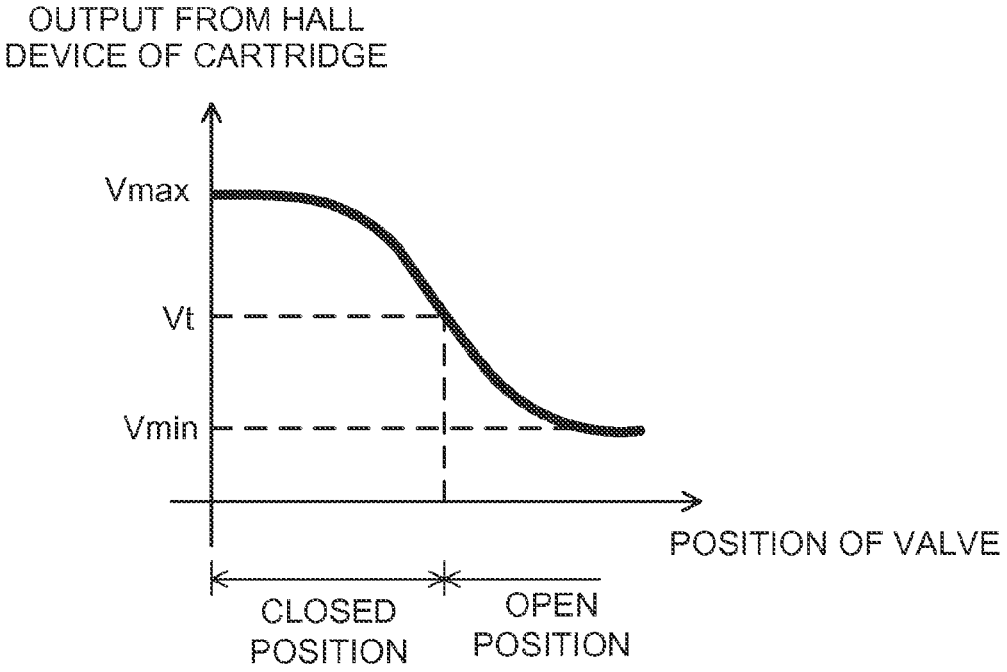
FIG. 12 is a graph showing a relationship between a position of the valve of the cartridge and an output value from a Hall device of the cartridge, according to an embodiment of the invention.

FIG. 12 is a graph showing a relationship between a position of the valve 60 and an output value from the Hall device 71. The horizontal axis may represent the position of the valve 60 in the first cartridge direction. The vertical axis may represent output values from the Hall device 71. Vmax is an output value from the Hall device 71 to which a predetermined drive voltage is applied when the valve 60 is in the closed position shown in FIG. 5A. Vmin is an output value from the Hall device 71 to which the predetermined voltage is applied when the valve 60 is in the open position shown in FIG. 5B. A threshold value Vt (e.g., Vt=(Vmax+Vmin)/2)) may be obtained based on the output values Vmax and Vmin read by the controller 100 in Step S3. When the output value from the Hall device 71 received in Step S8 is less than or equal to the threshold value Vt, the controller 100 determines that the valve 60 is in the open position. When the output value from the Hall device 71 received in Step S8 is larger than the threshold value Vt, the controller 100 may determine that the valve 60 is in the closed position.

When a predetermined time has elapsed while the valves 60 of the black ink unit 40B and the pretreatment liquid unit 40P are not in the open positions, e.g., "YES" at Step S10, the controller 100 may notify an error at Step S5, and the controller 100 stops operations of each components of the printer 1 at Step S6. The open error may occur due to a breakage of the Hall device 71 of the black ink unit 40B caused by a short circuit occurred between the terminal 170*c* and the terminal 174*c*, due to a breakage of the Hall device 71 of the pretreatment liquid unit 40P caused by a short circuit occurred between the terminal 171*a* and the terminal 174*c*, due to a malfunction in communications capabilities of the controller caused by a short circuit occurred between the terminal 173*c* and the terminal 174*c*, or due to existence of a defective condition in the plugs 50 or the valves 60 of the cartridge 40, or the hollow tubes 153 or the moving mechanism 155 of the printer 1.

When the controller 100 determines that the valves 60 of the black ink unit 40B and the pretreatment liquid unit 40P are in the open positions, e.g., "YES" at Step S9, then in Step S11, controller 100 writes, in the memory 144, data of a value that obtained by adding 1 (one) to the number of hollow tube insertions read in Step S3. Then, in Step S12, the controller 100 determines whether a recording command has been received from the external device.

When the controller 100 determines that the recording command has been received, e.g., "YES" in Step S12, then in Step S13, controller 100 performs recording of a page of a sheet P by controlling the sheet feed motor 125, the transport motor 127, the discharge motor 128, and the heads 2. After Step S14, the controller 100 calculates a current liquid usage amount for one page of a sheet, i.e., an amount of black ink and an amount of pretreatment liquid that were discharged onto the page of the recorded sheet P during the current recording operation at Step S11.

After Step S14, then in Step S15, the controller 100 writes, into the memory 141, data of the liquid usage amount of the black ink and the liquid usage amount of the pretreatment liquid (the total amount of liquid that has been used in each reservoir 42 since the cartridge 40 is in a brand-new condition, i.e., a value obtained by adding the current liquid usage amount for one page of the sheet P obtained in Step S14 to the liquid usage amount read in Step S3 with respect to each of the black ink and the pretreatment liquid) and data of the number of recorded sheets (the number of sheets P that have been recorded by using the cartridge 40 since the cartridge 40 is in a brand-new condition, i.e., a value obtained by adding 1 (one) to the number of recorded sheets read in Step S3.

After Step S12, then in Step S16, controller 100 determines whether a write error has occurred. When the controller 100 could not perform a writing procedure normally, the controller 100 determines that a write error has occurred, e.g. "YES" at Step S16. Then, the controller 100 notifies the error in Step S5 and stops operations of each component of the printer 1 in Step S6.

The write error may occur due to damage to the memory 141 caused by a short circuit occurred between the terminal 172*c* the terminal 174*c* or due to a malfunction in communications capabilities of the controller 100 caused by a short circuit occurred between the terminal 173*c* and the terminal 174*c*. When the controller 100 could perform a writing procedure normally, the controller 100 determines that a write error has not occurred, e.g., "NO" in Step S16, and in Step S17, controller 100 determines whether the recording command includes data of a next page based on the image data included in the recording command received in Step S12.

When the recording command includes data of a next page, e.g., "YES" at Step S17, the controller 100 returns the routine to Step S13 and executes the processing of Step S13 to Step S16. When the recording command does not include data of a next page, e.g., "NO" at Step S17, the controller 100 returns the routine to Step S12 and waits until the controller 100 determines that a recording command is received.

The printer 1 comprises a lock mechanism (not shown) configured to lock the cartridge 40 in the predetermined position. When the controller 100 determines that the cartridge 40 has been installed in the predetermined position in the space C, e.g., "YES" at Step S1, the controller 100 may, in an embodiment of the invention, drive the lock mechanism simultaneously with the processing of Step S2, for example, to lock the cartridge 40 in the predetermined position together with the tray 35.

To remove the cartridge 40 from the printer 1, a release button is pressed. When the controller 100 detects the pressing of the release button, first, the controller 100 controls the moving mechanism 155, e.g., as shown in FIG. 9, to move the support member 154 in a direction reverse to the direction indicated by the bold arrow of FIG. 8C. Thus, the support member 154 may move from the position shown in FIG. 8C to the position shown in FIG. 8B. At that time, in accordance with the movement of the hollow tube 153 leftward in FIG. 5B in each of the black ink unit 40B and the pretreatment liquid unit 40P, the valve 60 also may move leftward in FIG. 5B and may contact the valve seat 43*z* by the urging force of the coil spring 63.

Thus, the valve 60 may transition from the open position to the closed position. When the output values received from the Hall device 71 exceed the threshold value Vt in each of the black ink unit 40B and the pretreatment liquid unit 40P, the controller 100 may determine that the valves 60 are in closed positions and may obtain the current usage time, e.g., the period between the installation time and a removal time at which the controller 100 determines that the valves 60 are in closed positions, based on the installation time recorded in Step S2 and the removal time. The controller 100 writes, into the memory 141, data of a value obtained by adding the cumulative usage time read in Step S3, i.e., the total period of time during which the cartridge 40 has been installed in the printer 1 since the cartridge 40 is in brand-new condition, to the obtained current usage time.

After that, the hollow tube 35 may be removed from the plug 50. At that time, the hole formed in the plug 50 by the hollow tube 153 may become smaller by the elasticity of the portion surrounding the hole so as to prevent the leakage of liquid from the gap between the hole of the plug 50 and the hollow tube 153. Then, the controller 100 may drive the lock mechanism to release the cartridge 40. Therefore, the tray 35 can be removed from the space C. When the tray 35 is removed from the space C, the substrate 142 of the cartridge 40 may be separated from the substrate 182 of the printer 1. Therefore, electric connections between the terminals 170*c* to 177*c* and the corresponding terminals 170*p* to 177*p* may be released, and the electric power is not supplied to the Hall devices 71 and the memory 141. Accordingly, the controller 100 does not perform further signal transmission and reception with the Hall devices 71 and the memory 141.

Figure 10:
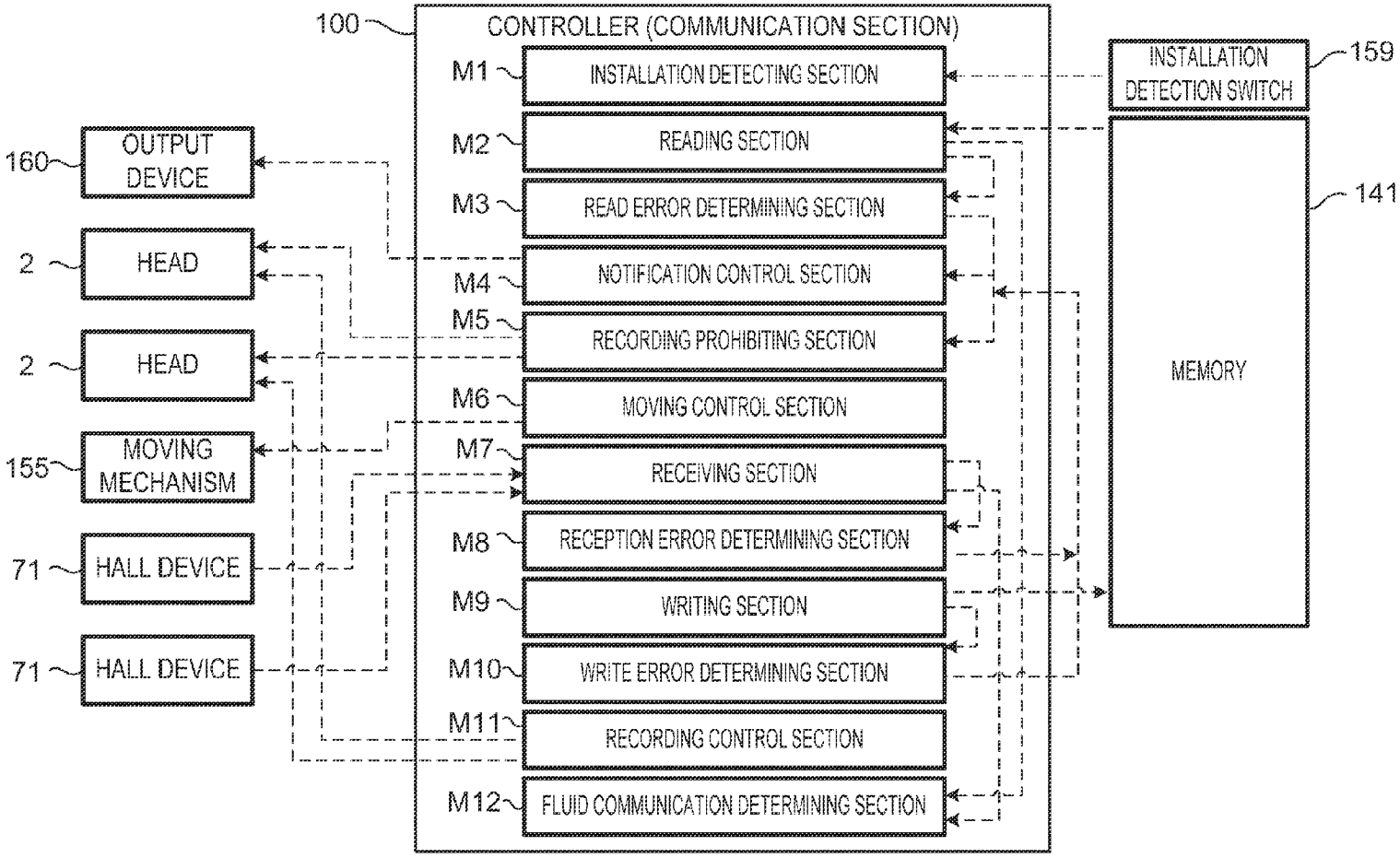
FIG. 10 is a functional block diagram showing sections embodied by a controller of the printer, according to an embodiment of the invention.

The controller 100 may control to display a value obtained by reducing the liquid usage amount written into the memory 141 in Step S15 from the liquid reservoir capacity, on the output device 160, such as a display, of the printer 1, as an amount of liquid remaining in each reservoir 42. The controller 100 may further comprise a communication section for performing communications with the cartridge 40 installed in the space C, as shown in FIG. 10, and also may comprise each section corresponding to the processing of FIG. 11.

A cartridge installation detecting section M1 may embody the processing of S1. A reading section M2 may embody the processing of S3. A read error determining section M3 may embody the processing of S4. A notification control section M4 may embody the processing of S5. A recording prohibiting section M5 may embody the processing of S5. A moving control section M6 may embody the processing of S7. A receiving section M7 may embody the processing of S8. A receiving error determining section M8 may embody the processing of S9 and S10. A writing section M9 may embody the processing of S11. A write error determining section M10 may embody the processing of S16. A recording control section M11 may embody the processing of S13. A fluid communication determining section M12 may embody the processing of S9.

Referring to FIGS. 13 to 17, additional embodiments of the invention will be described. Printers and cartridges of the additional, e.g., another embodiment to a yet further embodiment of the invention have substantially the same structure as the printer 1 and the cartridge 40 of the first embodiment of the invention except arrangements or structures of terminals provided to the cartridges and the housings of the printers, as described herein.

Figure 13:
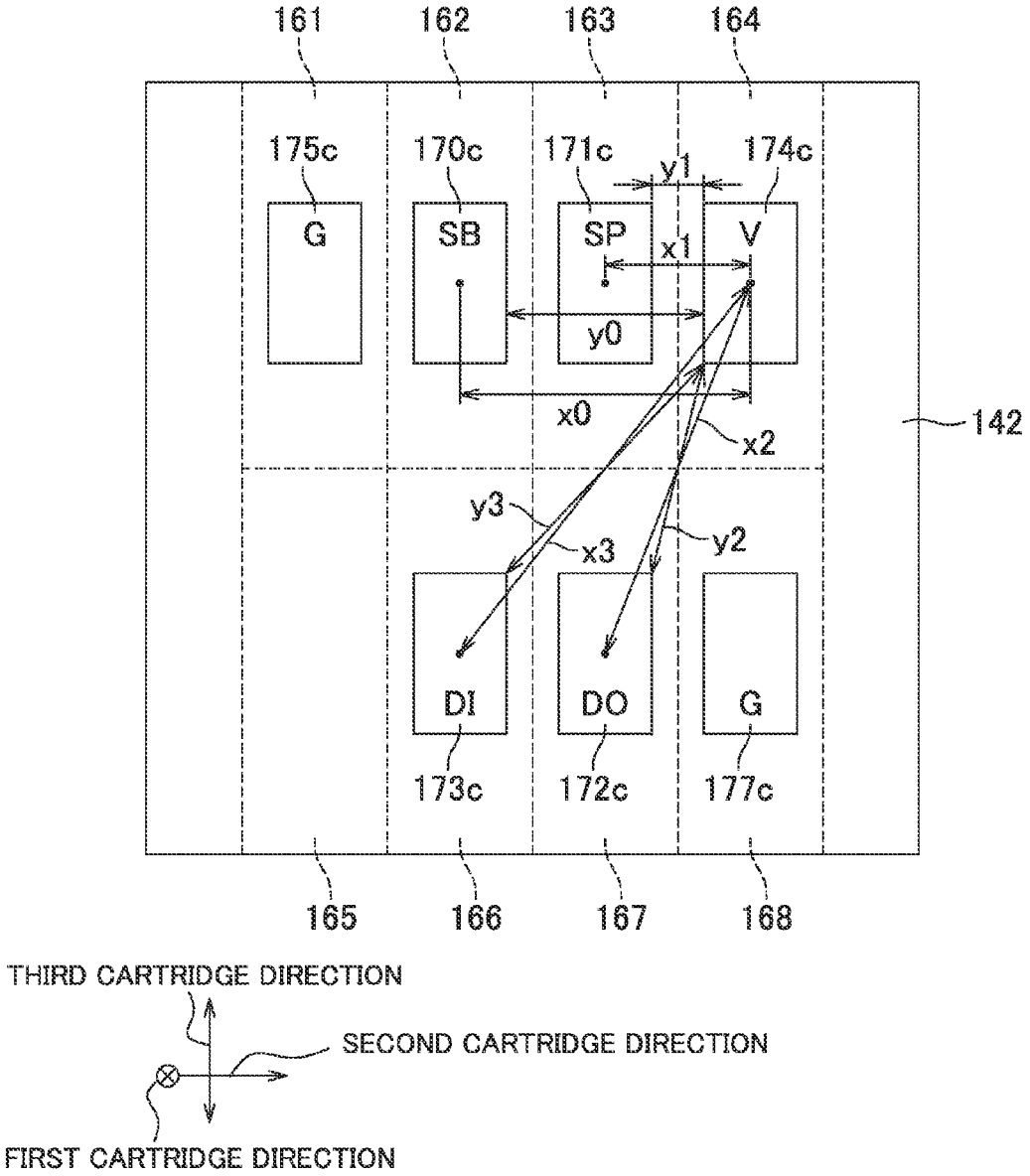
FIG. 13 is a drawing showing terminals of a cartridge according to another embodiment of the invention.
Figure 14:
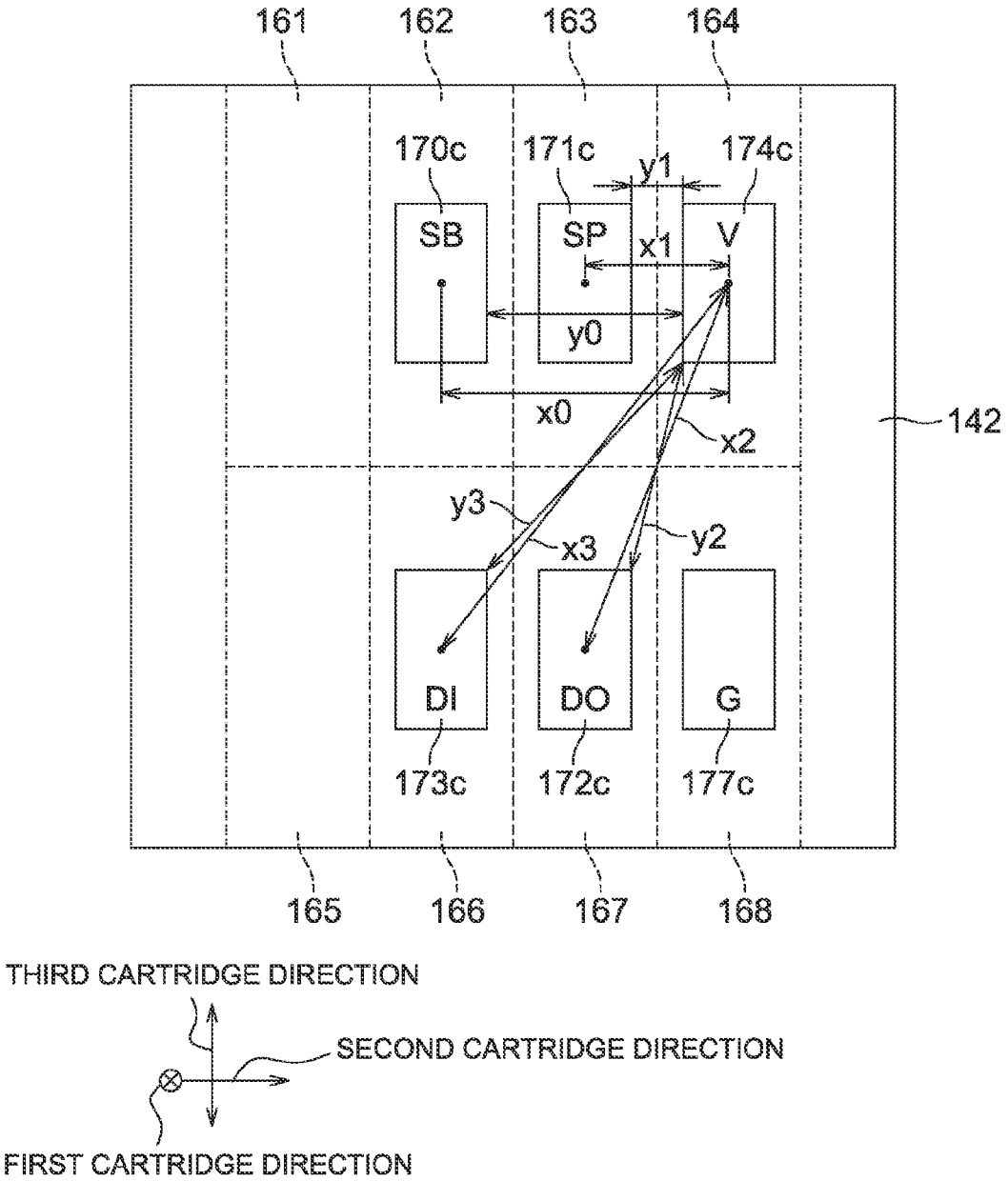
FIG. 14 is a drawing showing terminals of a cartridge according to a yet another embodiment of the invention.
Figure 15:
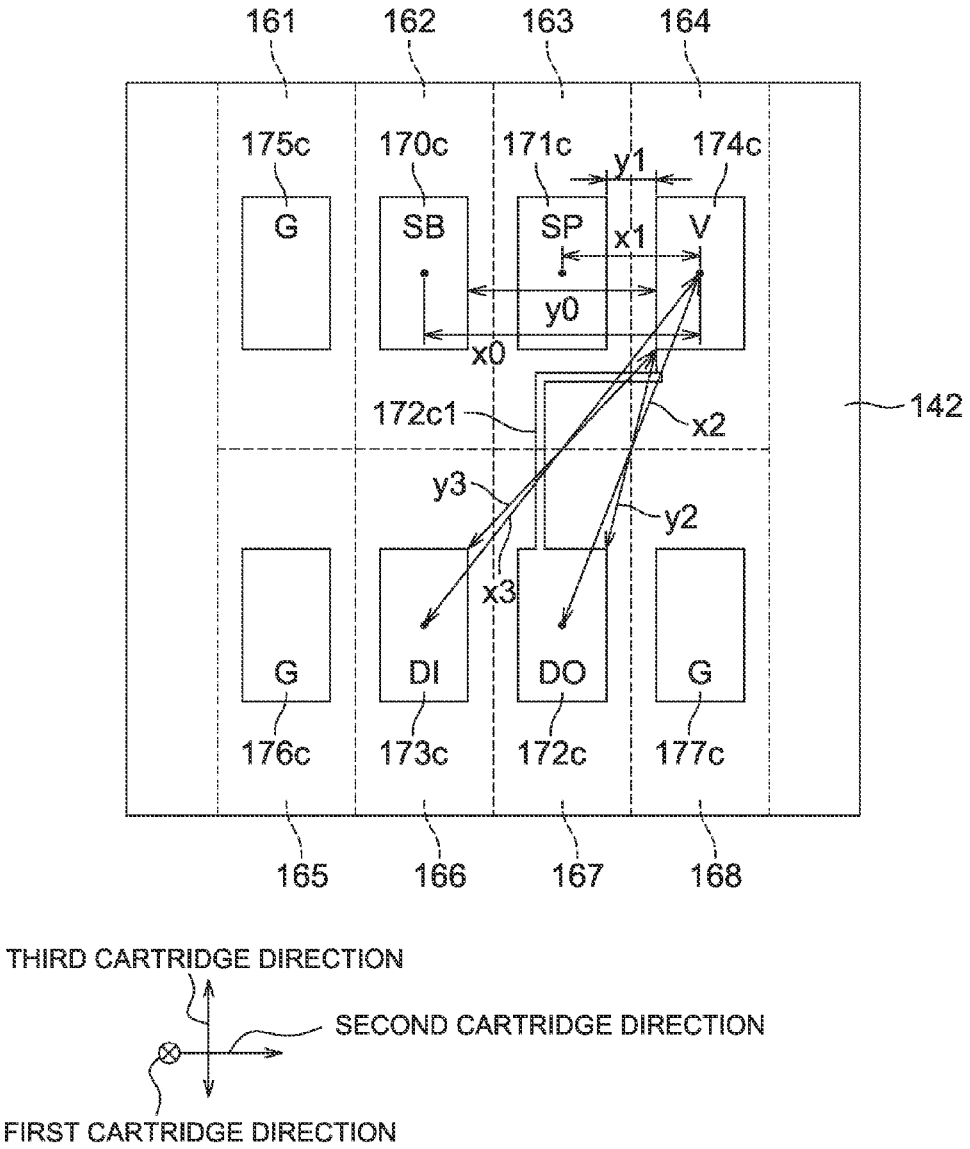
FIG. 15 is a drawing showing terminals of a cartridge according to still another embodiment of the invention.

As compared with the cartridge 40 according to the embodiment shown in FIG. 7, a cartridge 40 according to another embodiment may comprise terminals 170*c*, 171*c*, 172*c*, 173, 174*c*, 175*c*, 177*c* as shown in FIG. 13, i.e., the ground terminal 176*c* may be omitted from the cartridge 40. As compared with the cartridge 40 according to the embodiment shown in FIG. 7, a cartridge 40 according to yet another embodiment may comprise terminals 170*c*, 171*c*, 172*c*, 173*c*, 174*c*, 177*c* as shown in FIG. 14, i.e., the ground terminals 175*c* and 176*c* may be omitted from the cartridge 40. As compared with the cartridge 40 according to the embodiment shown in FIG. 7, a cartridge 40 according to the still another embodiment may comprise terminals 170*c* to 177*c* as shown in FIG. 15. The data output terminal 172*c* of the cartridge 40 of the still another embodiment may have an L-shaped extended portion 172*c*1. The extended portion 172*c*1 may extend from one end toward the terminal 171*c*, and may bend and further extend toward the electric power input terminal 174*c*.

Figure 16:
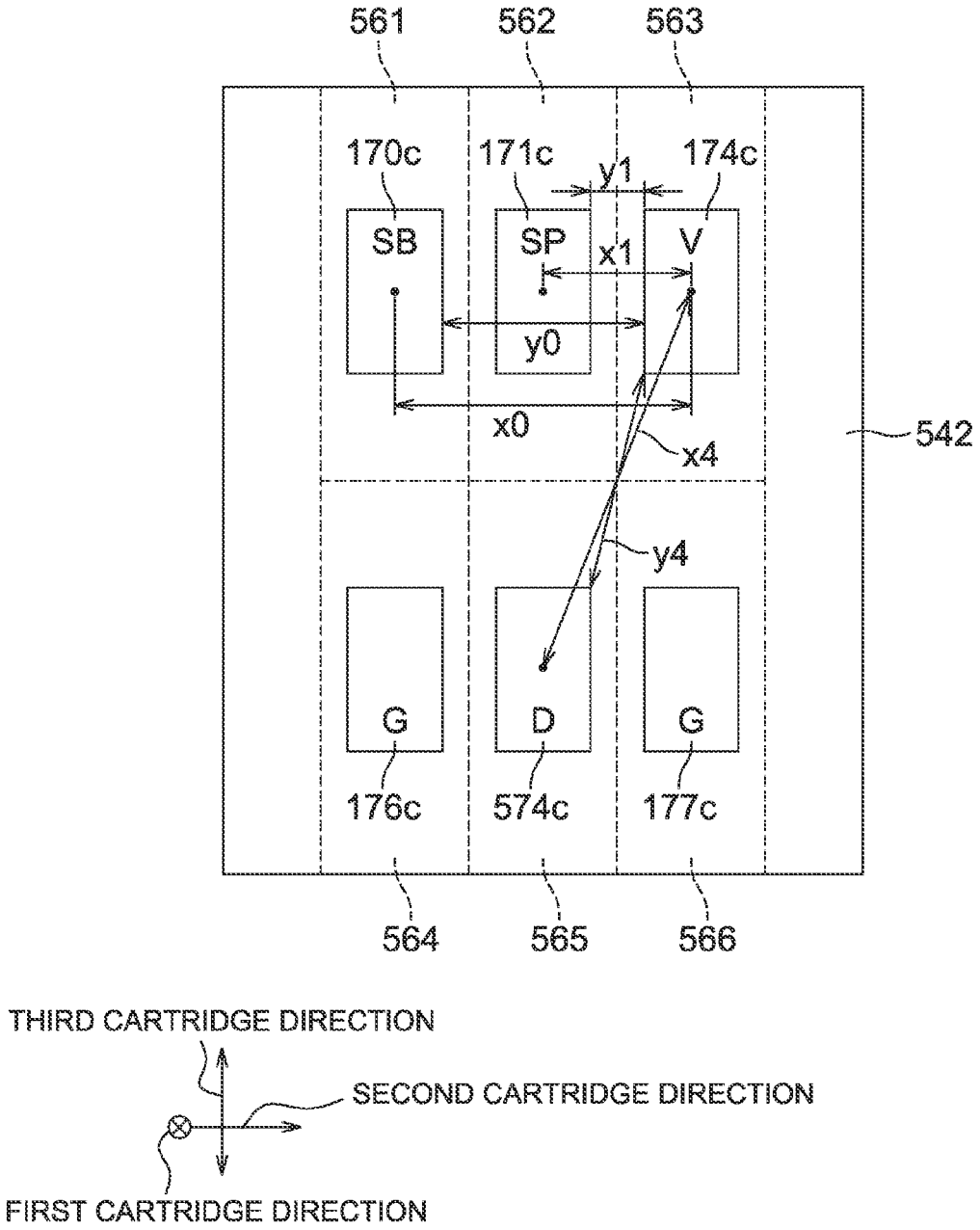
FIG. 16 is a drawing showing terminals of a cartridge according to a further embodiment of the invention.

As compared with the cartridge 40 according to the embodiment shown in FIG. 7, a cartridge 40 according to the further embodiment may comprise terminals 170$c$, 171$c$, 174$c$, 176$c$, 177$c$ and a data input/output terminal 574$c$ as shown in FIG. 16. The data input/output terminal 574$c$ may have functions of the data output terminal 172$c$ and the data input terminal 173$c$. The ground terminal 175$c$ may be omitted from the cartridge 40. The terminals 170$c$, 171$c$, 174$c$, 176$c$, 177$c$, 574$c$ may be arranged in two rows, each of which may include three terminals. A substrate 542 of the cartridge 40 of the further embodiment of the invention may have a width narrower than the substrate 142 of the cartridge 40 of the embodiment shown in FIG. 7.

In a further embodiment of the invention, each distance between centers of the terminal 174$c$ and a respective one of the terminals 170$c$, 171$c$, 574$c$ is x0, x1, x4 and each shortest distance between edges of the terminal 174$c$ and a respective one of the terminals 170$c$, 171$c$, 574$c$ is y0, y1, y4. The terminals 174$c$, 170$c$, 171$c$, 574$c$ are arranged on the substrate 542 such that their positional relationship satisfies $x1<x0<x4$ and $y1<y0<y4$. In a further embodiment, xn (n=0 or 1) represents a distance between centers of terminals 174$c$ and 17$nc$, and yn (n=0 or 1) represents a shortest distance between edges of terminals 174$c$ and 17$nc$. In the further embodiment, y4 represents a distance between edges of the terminal 574$c$ and the terminal 174$c$.

Figure 17:
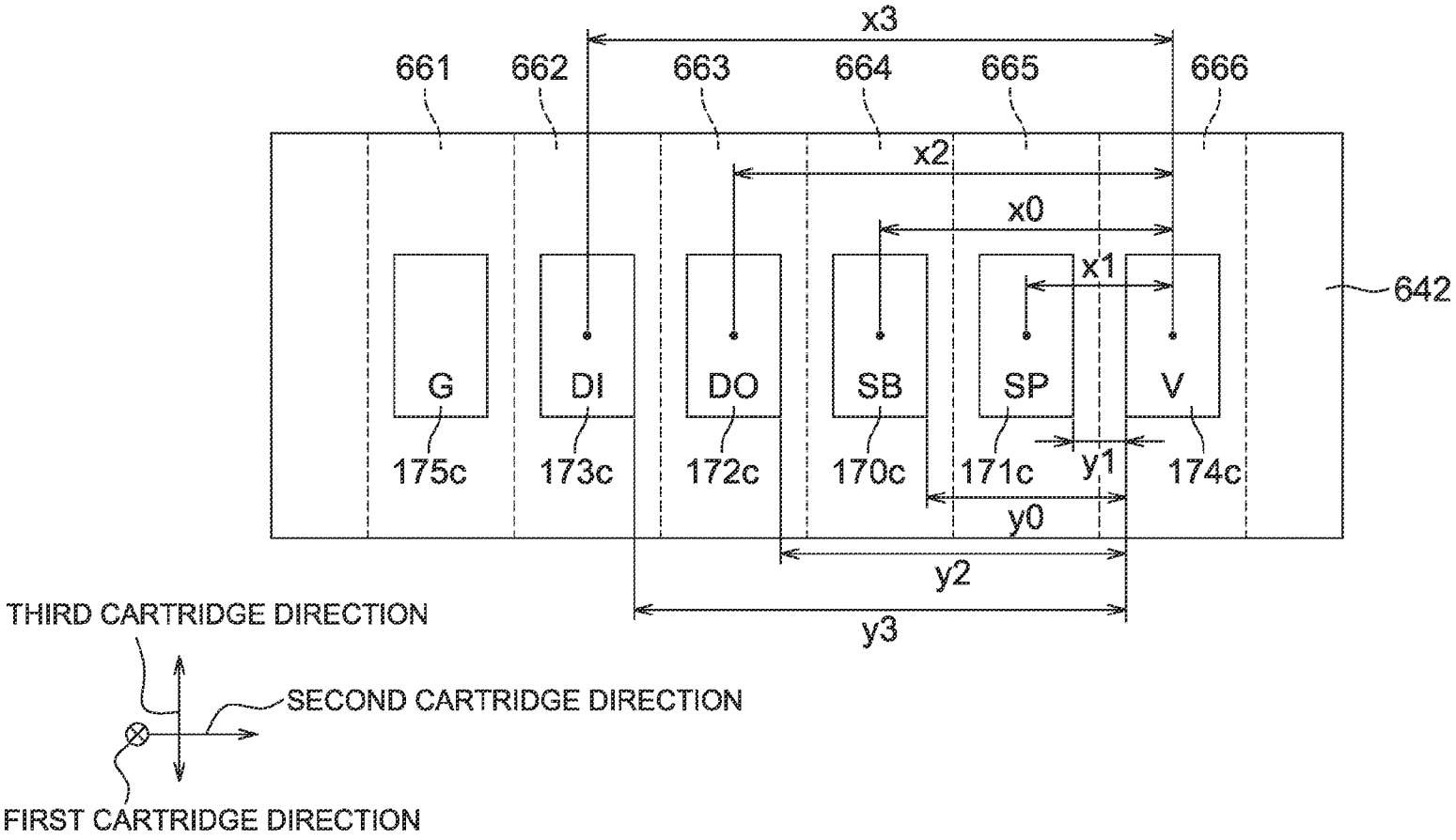
FIG. 17 is a drawing showing terminals of a cartridge according to a yet further embodiment of the invention.

As compared with the cartridge 40 according to the embodiment shown in FIG. 7, a cartridge 40 according to the yet further embodiment may comprise the terminals 170$c$ to 175$c$ aligned in a row as shown in FIG. 17. The ground terminals 176$c$ and 177$c$ may be omitted, and the cartridge 40 of the yet further embodiment may comprise the ground terminal 175$c$ only. A substrate 642 of the cartridge 40 in the yet further embodiment of the invention may be shorter in height and wider in width than the substrate 142 of the cartridge 40 of the embodiment shown in FIG. 7.

In each of the another to yet further embodiments of the invention, terminals and substrates provided to the housing 1$a$ of the printer 1 may be configured to correspond to the terminals and the substrates provided to the cartridge 40. As described above, according to each of the above-described embodiments of the invention, the distance between the data output terminal 172$c$, e.g., the data input/output terminal 574$c$ in the further embodiment, and the electric power input terminal 174$c$ is greater than the distance between the electric power input terminal 174$c$ and the respective one of the sensor signal output terminals 170$c$ and 171$c$.

In the still another embodiment, each distance between a specific terminal and a respective one of specific terminals may be defined without consideration of the existence of the extended portion 172$c$1, which may have no potential for contacting with any of the terminals of the housing 1$a$ even if the cartridge 40 is displaced in the predetermined position. The extended portion 172$c$1 of the terminal 172$c$ may be not a main portion of a terminal according to the still another embodiment of the invention. A main portion of each terminal of the cartridge may refer to a portion that has a potential for contacting a corresponding one of the terminals of the housing 1$a$. In the above-described embodiments, the main portion may substantially refer to the entire portion of each respective terminal. In the still another embodiment, the main portion may refer to the entire portion of each terminal other than the terminal 172$c$, and may refer to a portion of the terminal 172$c$ except the extended portion 172$c$1. In other embodiments of the invention, the main portion of each terminal may include a center area of any size of the terminal. In still other embodiments of the invention not described in detail herein, the main portion of each terminal may be any portion disposed on the terminal.

In the above-described embodiments, each shortest distance between edges of a main portion of a specific terminal and a respective one of main portions of specific terminals and each distance between centers of a main portion of a specific terminal and a respective one of main portions of specific terminals provided on each substrate 142, 542, 642 may be defined as described above.

In the first described embodiment to the further embodiment, the main portions of the terminals may be arranged in a matrix in the second cartridge direction and the third cartridge direction on each substrate 142, 542. That is, the substrate may be aligned in a grid pattern, and the main portions of the terminals may be disposed on cells of the grid of each substrate 142, 152. The sensor signal output terminals 170$c$ and 171 $c$ and the electric power input terminal 174$c$ may be arranged in this order in the second cartridge direction such that their main portions may be adjacent to each other. The data output terminal 172$c$, e.g., the data input/output terminal 574$c$ in the further embodiment, and the electric power input terminal 174$c$ may be arranged such that their main portions are not adjacent to each other in either the second cartridge direction or the third cartridge direction, i.e., their main portions are arranged in positions oblique to each other.

In the first described embodiment to the still another embodiments, the substrate 142 may have areas 161 to 168 arranged in a matrix, e.g., a grid pattern, with rows and columns in the second cartridge direction and the third cartridge direction. The substrate 542 may have areas 561 to 566 arranged in a matrix with rows and column in the second cartridge direction and the third cartridge direction. The terminals of the cartridge 40 may be arranged such that each terminal includes the center of the corresponding area 161 to 168. The area 164 on which the electric power input terminal 174$c$ is disposed at its center, the area 163 on which the sensor signal output terminal 171$c$ is disposed at its center, and the area 162 on which the electric power input terminal 174$c$ is disposed at its center, may be arranged in this order adjacent to each other in the second cartridge direction. The area 164 and the area 167 on which the data output terminal 172 is disposed at its center may be arranged such that they are not located adjacent to each other in either the second cartridge direction or the third cartridge direction, i.e., they may be arranged in positions oblique to each other. In the fifth embodiment, the substrate 542 has areas 561 to 566 arranged in a matrix with rows and column in the second cartridge direction and the third cartridge direction.

The terminals of the cartridge 40 may be arranged such that each terminal includes the center of the corresponding area 561 to 566. The area 563 on which the electric power input terminal 174$c$, the area 562 on which the sensor signal output terminal 171$c$ is disposed at its center, and the area 561 on which the electric power input terminal 174$c$ is disposed at its center, may be arranged in this order adjacent to each other in the second cartridge direction. The area 563 and the area 565 on which the data input/output terminal 574$c$ is disposed at its center may be arranged such that they are not located adjacent to each other in either the second cartridge direction or the third cartridge direction, i.e., they may be arranged in positions oblique to each other.

In the yet further embodiment, the main portions of the terminals may be arranged in the second cartridge direction on the substrate 642. The sensor signal output terminals 170$c$ and 171$c$ and the electric power input terminal 174$c$ may be arranged in this order in the second cartridge direction such that their main portions are adjacent to each other. The data output terminal 172$c$ and the electric power input terminal 174$c$ may be arranged such that their main portions are not adjacent to each other in the second cartridge direction, i.e., an other terminal is interposed between the data output terminal 172*c* and the electric power input terminal 174*c*.

The substrate 42 may have areas 661 to 666 arranged in a row in the second cartridge direction. The terminals of the cartridge 40 may be arranged such that each terminal includes the center of the corresponding area 661 to 666. The area 666 on which the electric power input terminal 174*c* is disposed at its center, the area 665 on which the data output terminal 171*c* is disposed at its center, and the area 664 on which the data output terminal 170*c* is disposed at its center, may be arranged in this order adjacent to each other in the second cartridge direction. The area 666 and the area 663 on which the data output terminal 172*c* is disposed at its center may be arranged such that they are not located adjacent to each other in the second cartridge direction, i.e. other area is interposed between the area 666 and the area 663.

In the first described embodiment to the yet further embodiments, the influence of a short circuit may be reduced or prevented by the positional relationship of the terminals as described above. The memory 141 is configured to store data, which relates to signals generated by the Hall devices 71, e.g., the output values Vmax and Vmin from the Hall devices 71, and may be used for the determination of positions, e.g., the open position or the closed position of the valves 60, e.g., the determination of establishment of fluid communication between the heads 2 and the corresponding reservoirs 42. Accordingly, if one of the memory 141 and the Hall devices 71 is damaged due to a short circuit while the cartridge 40 is installed in the space C, before a recording control is started, the controller 100 may be unable determine whether the heads 2 and the corresponding reservoirs 42 are in fluid communication with each other. Thus, the controller 100 may be unable to perform the recording control. As compared with the case where the Hall device 71 is damaged, if the memory 141 is damaged due to a short circuit, additional situations which may be difficult for performing recording may occur, in addition to the above problem.

For example, a manufacturer may not provide timely service to a user based on the data stored in the memory 141. The manufacturer records the length of time each reservoir 42 of a cartridge 40 will provide liquid based on the cumulative usage time and the number of recorded sheets stored in the memory 141, and the manufacturer may provide a new cartridge 40 to the user at about the time the reservoirs become empty of liquid. The manufacturer may be unable to provide such a timely service to the user if the memory 141 is damaged.

Moreover, the recycle efficiency of the cartridge 40 may be decreased in a case where the cartridge 40 is recycled based on the data stored in the memory 141. For example, it cannot be determined whether the life of each plug 50 of the cartridge 40 is within its useful time if the data of the number of hollow tube insertions stored in the memory 141 is lost. Thus, a plug 50, which is unnecessary to be replaced because its life is within the useful time, may be replaced with a new one, thereby decreasing the recycle efficiency. In addition, the manufacturer may be unable to charge a user based on the data stored in the memory 141, e.g., the liquid usage amount and/or the number of recorded sheets.

In the first described embodiment to the yet further embodiments, the protection of the memory 141 may have a priority over the protection of the Hall devices 71, by which the positional relationship of the terminals is specified as described above. Accordingly, the influence of a short circuit, e.g., as described in the situations above, may be reduced or prevented.

In an embodiment of the invention, the controller 100 of the printer 1 may performs the writing of the liquid usage amount and the number of recorded sheets into the memory 144 in Step S15, and the determination on the presence or absence of an error in the writing into the memory 141 in a period between the recording of a page of a sheet and the recording of the next page of a sheet. Therefore, if the memory 141 is damaged due to a short circuit occurred between the data output terminal 172*c*, e.g., the data input/output terminal 574*c* in the further embodiment and the electric power input terminal 174*c* during the recording of a page of a sheet, the controller 100 may determine that a write error has occurred, e.g., "YES" at Step S16, and may notify the error in Step S5 to prohibit the further recording operation, and stops operations of each components of the printer 1 in Step S6.

On the other hand, the controller 100 does not perform the determination on the presence or absence of an error in receipt of signals from the Hall devices 71 in a period between the recording of a page of a sheet and the recording of the next page of a sheet. Therefore, if either or both of the Hall devices 71 are damaged due to a short circuit occurred between the electric power input terminal 174*c* and the sensor signal output terminal 170*c* and/or between the electric power input terminal 174*c* and the sensor signal output terminal 171*c*, the controller 100 continues to perform the recording operation Thus, in an embodiment of the invention, the recording operation may be continued even if either or both of the Hall devices 71 are damaged during the execution of the recording control although the recording operation cannot be continued if the memory 141 is damaged during the execution of the recording control.

In the first to sixth embodiments, the protection of the memory 141 takes priority over the protection of the Hall devices 71 by which the positional relationship of the terminals is specified as described above. Accordingly, the influence of a short circuit on the recording operation can be prevented.

The terminals of the cartridge 40 and the terminals of the housing 1*a* may be designed such that their centers contact with each other, respectively. Accordingly, the influence of the short circuit caused by foreign matters adhered to the contact portion may be reduced or prevented by the positional relationship defined with reference to each distance between the centers of the contact portions of the specific terminals.

As described above, according to the first described embodiment to the still another embodiment, and the yet further embodiment of the invention, the distance between the data input terminal 173*c* and the electric power input terminal 174*c* may be greater than the distance between the data output terminal 172*c* and the electric power input terminal 174*c*. The memory 141 may be damaged if a short circuit occurs between the data output terminal 172*c* and the electric power input terminal 174*c*. The controller 100 may be damaged if a short circuit occurs between the data input terminal 173*c* and the electric power input terminal 174*c*. Replacement of the controller 100 may cost more than replacement of the memory 141. Accordingly, the controller 100 may be prevented from being damaged by the positional relationship between the terminals as described above, and the costs for replacement of the components due to the short circuit may be reduced. In the fifth embodiment, the data input/output terminal 574*c* functions as both of the data output terminal and the data input terminal. Therefore, the configuration of the terminals and the wiring on the substrate can be simplified.

The terminals to be provided to the liquid cartridge may be modified as described below. The terminals may be separately provided on a plurality of substrates. The shape of the terminals may not be limited to a rectangle, but any shape, e.g., a circle, may be acceptable. The terminals may be arranged in random pitches. Although the terminals of the above-described embodiments are provided on the surface that extends in the direction perpendicular to the inserting direction of the cartridge 40, the terminals may be provided on other surface, e.g., a surface that extends in parallel to the inserting direction. The number of sensor signal output terminals to be provided may be changed along with the number of sensors to be provided.

An arbitrary number of ground terminals may be provided, or otherwise, the ground terminals may be omitted. The electric power input terminal may be electrically connected with at least one of the sensor and the storage so as to supply electric power to at least one of the sensor and the storage, e.g., electric power may be supplied to the storage via the data input terminal. At least one electric power input terminal may be provided. Two or more electric power input terminals may be provided in other embodiments. The terminals may be arranged such that their positional relationships satisfy at least one of the distance conditions of the distance between the centers of the terminals and the shortest distance between the edges of the terminals. In other embodiments not described in detail herein, other positions may be used.

The arrangements or size of the terminals may be changed if their positional relationships satisfy the distance conditions. For example, in FIG. 7, the data input terminal 173*c* and the data output terminal 172*c* may switch their positions. The sensor signal output terminal 170*c* and the sensor signal output terminal 171*c* may be switched their positions. The electric power input terminal 174*c* may be disposed at the left right corner, at the upper left corner, or at the lower left corner, on the substrate 142, or may be disposed at any positions other than the corners. The number of rows including the terminals and the number of terminals to be included in each row may be arbitrarily determined. The terminals may be arranged in a circle or in a random fashion.

The terminals to be provided to the housing of the printer may be modified as described below. The terminals may have the substantially same or larger size than the terminals of the liquid cartridge. The number of terminals may not be equal to the number of terminals to be provided to the liquid cartridge. The arrangement of the terminals may not be partially correspond to that of the terminals to be provided to the liquid cartridge. For example, the terminals of the liquid cartridge may be arranged in two rows, each of which includes three terminals as shown in FIG. 14, and the terminals of the housing may be arranged in two rows, each of which includes four terminals. In this case, a few of the terminals of the housing do not contact the terminals of the liquid cartridge. Similar to this configuration, the number of terminals of the liquid cartridge may be unequal to the number of terminals of the housing and the arrangement of the terminals of the liquid cartridge may only partially correspond to that of the terminals of the housing. In this case, also, a few of the terminals of the liquid cartridge do not contact the terminals of the housing.

The terminals may be made of leaf springs (the terminals urged toward a direction that the terminals approach the terminals of the liquid cartridge by their urging forces) or may be made of other materials. The terminals of the housing and the terminals of the liquid cartridge may be designed such that the terminals of the housing contact the corresponding terminals of the liquid cartridge at portions other than their centers if their positional relationships satisfy the distance conditions with reference to the contact portions.

The structures of the liquid cartridge may be modified as described below. The sensors are not limited to the magnetic sensors such as the Hall devices 71. Sensors of different types, e.g., photosensors of reflection type or transmission type, or mechanical sensors configured to determine whether or not to contact an object to detect the presence or absence of the object, may be used instead. The sensor may be configured to directly or indirectly detect the presence or absence of the object that is to be inserted into the flow path. Although the Hall devices 71, which are configured to detect the opening or closing of the valves 60, are used as such the sensor in the above-described embodiments, for example, an installation detecting sensor, which is configured to detect the installation of the liquid cartridge in a cartridge installation portion, may be used as such the sensor when the object is inserted into the flow path and exists therein at the substantially same time of the installation of the liquid cartridge in the cartridge installation portion. For example, the installation detection switch 159 or the photosensors used in the above-described embodiments may be used as the installation detecting sensor. At least one sensor may be provided in the liquid cartridge. The liquid cartridge may store multiple kinds and types of liquid, or only one kind of liquid.

Data to be stored in the storage may not be limited to specific data described above. The storage may store data that can lead to the output values and the amount of liquid remaining in the liquid reservoir, instead of the output values and the amount of liquid remaining in the liquid reservoir themselves, as data relating to the signals generated by the sensors and the amount of liquid remaining in the liquid reservoir. The structures, e.g., shapes or arrangements, of the components of the liquid cartridge, e.g., the housing 41, the reservoirs 42, the ink outlet tubes 43, the plugs 50, the valves 60, the sensor units 70, the memory 141, and the substrate 142, may be changed as necessary, other components may be added to the liquid cartridge, or some of the components may be partially omitted from the liquid cartridge, without departing from the spirit and scope of the invention.

The controls performed in the main body of the image recording device may be modified as described below. The operations, e.g., discharging operations from the heads, of each component may be stopped without notification of an error. The timing at which signal transmission and reception becomes available between the liquid cartridge and the image recording device or the timing at which supply of electric power from the image recording device to the liquid cartridge becomes available may not be limited to the timing as described above. Those timings may be arbitrarily changed. In the above-described embodiments, the installation detection switch 159 of a mechanical sensor type is used as an installation detecting section configured to detect the installation of the liquid cartridge in the installing portion.

The sensor type may not be limited to the specific embodiments, and may be a photosensor, or a switch configured to output ON signals while electric connections are established between the image recording device and the liquid cartridge. The writing of data by the writing section and the determination on the presence or absence of an error by the write error determining section may be performed also before a recording command is received from an external device. The timings at which each section implements the functions, e.g., the timing at which the reading section reads data stored in the storage of the liquid cartridge, the timing at which the writing section writes data into the storage of the liquid cartridge, the timing at which the receiving section receives signals from the sensors, the timing at which the write error determining section determines the presence or absence of a write error, the timing at which the receiving error determining section determines the presence or absence of a receiving error, and the timing at which the moving section moves the hollow members, may be arbitrarily changed without departing from the scope of the invention.

The hollow members may not have pointed tips like needles. The liquid to be stored in the liquid cartridge is not limited to the ink or the pretreatment liquid. The liquid may be, for example, aftertreatment liquid to be discharged onto a recording medium for improving image qualities, or cleaning liquid for cleaning the transport belt.

At least one liquid cartridge may be provided to the image recording device, and the number of heads to be provided may not be limited to two. The image recording device may be a color inkjet printer comprising heads for discharging inks of black, magenta, cyan, and yellow.

The image recording device may be a line-type image recording device or a serial-type image recording device, but it is not limited to these devices. In other embodiments of the invention, the image recording device may be applied to not only printers but also facsimile machines or copying machines, or any other suitable machine for ejecting ink, for example.

Figure 20:
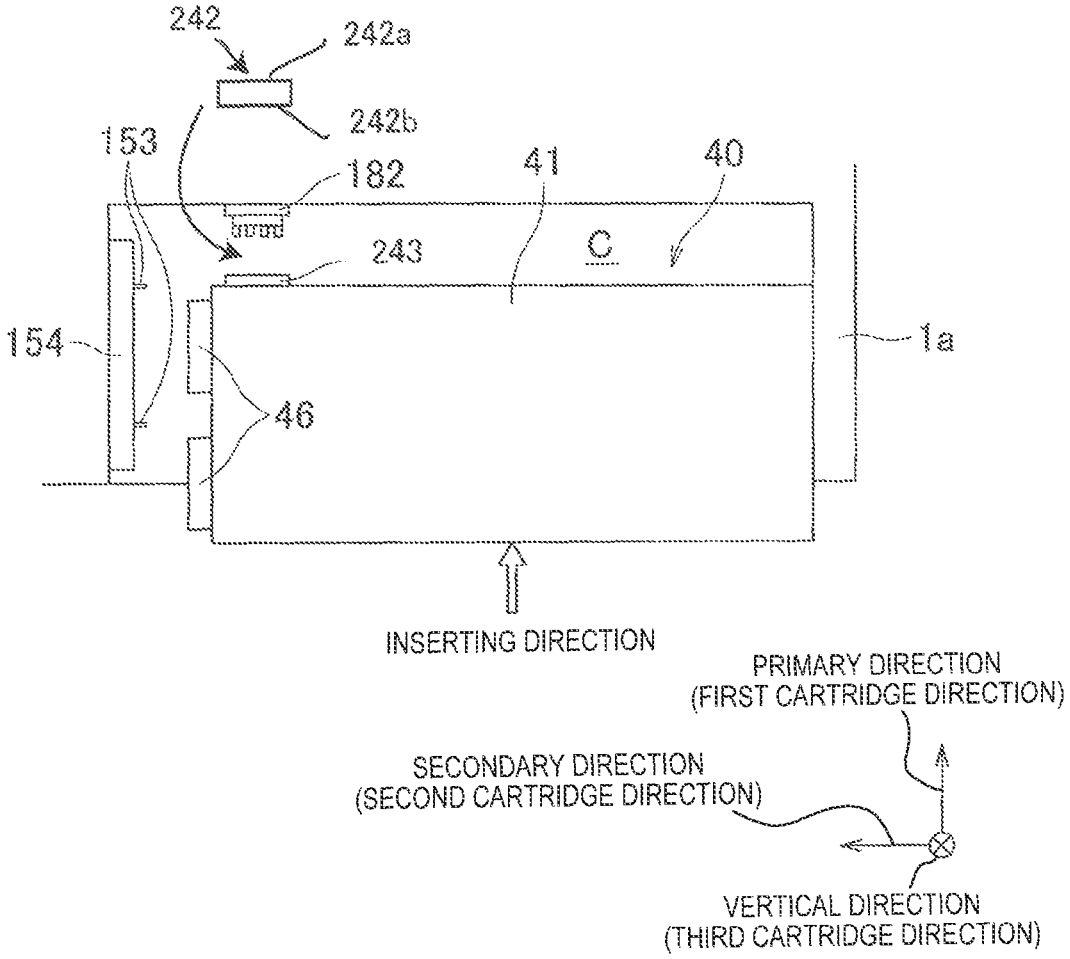
FIG. 20 is a plan view illustrating an adapter-type circuit board according to an embodiment of the invention.
Figure 21:
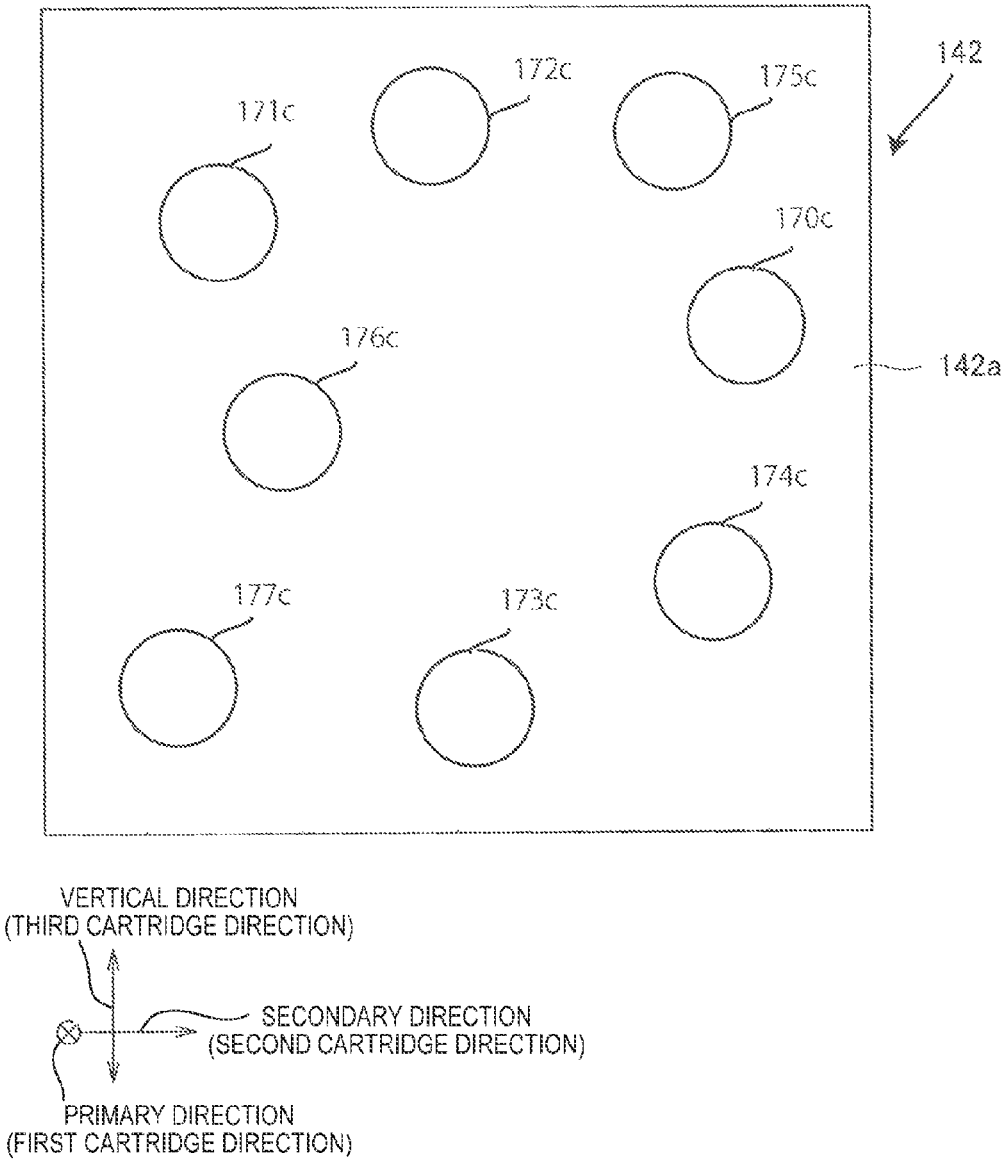
FIG. 21 is an explanatory diagram showing an example of the terminals on a cartridge connected to the adapter-type circuit, according to an embodiment of the invention.

While the circuit board 142 is fixed to the cartridge 40 in the preferred embodiment described above, an adapter-type circuit board 242 may be detachably mounted on the cartridge 40, as shown in FIG. 20. In this case, the terminals provided on a surface 242*a* of the adapter-type circuit board 242 that connects to the inkjet printer 1 may be arranged as described in the preferred embodiment (as shown in FIG. 7, for example), while the terminals of the circuit board 142 provided on the side of the cartridge 40 that connects to the other surface 242*b* of the adapter-type circuit board 242 may be arranged and shaped differently from the preferred embodiment described above, as in the example of FIG. 21.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A liquid cartridge comprising:

a liquid reservoir configured to store liquid therein;

a liquid flow path configured to selectively allow the liquid reservoir to be in fluid communication with an exterior of the liquid cartridge;

a sensor configured to output a signal relative to a position of a movable member disposed in the liquid flow path, the movable member movable between a first position and a second position;

a storage configured to store data therein;

a plurality of terminals, wherein the plurality of terminals comprises:

a sensor terminal connected to the sensor;

a power terminal connected to the sensor and configured to receive power from an exterior of the cartridge; and a data terminal connected to the storage, wherein a distance between at least a first portion of the power terminal and at least a portion of the data terminal is greater than a distance between at least a second portion of the power terminal and at least a portion of the sensor terminal, wherein the sensor is disposed outside the liquid flow path, and wherein the sensor is configured to face the movable member in the first position.

2. The liquid cartridge of claim 1, wherein the first portion is the same as the second portion.

3. The liquid cartridge of claim 1, wherein none of the plurality of terminals is disposed between the power terminal and the sensor terminal, and none of the plurality of terminals is disposed between the sensor terminal and the data terminal.

4. The liquid cartridge of claim 1, wherein the power terminal and the sensor terminal are aligned in a particular direction, and wherein the power terminal and the data terminal are not aligned in either the particular direction or in a further direction perpendicular to the particular direction.

5. The liquid cartridge of claim 1, wherein the data terminal, power terminal, and sensor terminal have a substantially rectangular shape.

6. The cartridge of claim 1, wherein the data terminal, the sensor terminal, and the power terminal all have substantially a same size.

7. The liquid cartridge of claim 1, wherein the sensor terminal comprises a first sensor terminal, and the plurality of terminals further comprises:

a second sensor terminal, wherein a distance between at least a portion of the second sensor terminal and the first portion of the power terminal is:

greater than the distance between the portion of the first sensor terminal and the first portion of the power terminal; and less than the distance between the portion of the data terminal and the second portion of the power terminal.

8. The liquid cartridge of claim 1, wherein the storage is configured to store data related to the signal outputted by the sensor.

9. The liquid cartridge of claim 1, wherein the storage is configured to store data related to an amount of liquid stored in the liquid reservoir.

10. The liquid cartridge of claim 1, wherein the storage is configured to store data related to a time at which the object is disposed in the liquid path.

11. The liquid cartridge of claim 1, wherein the storage is configured to store data related to a number of times that the object is inserted into the liquid path.

12. The liquid cartridge of claim 1, wherein the storage is configured to store data related to an amount of liquid that has moved from a first end of the liquid path to a second end of the liquid path opposite to the first end, wherein the first end of the liquid path is positioned at the liquid storing portion.

13. The liquid cartridge of claim 1, wherein the movable member is configured to selectively place the liquid reservoir in fluid communication with the exterior of the liquid cartridge via the liquid flow path.

14. The liquid cartridge of claim 1, wherein the first portion and the second portion of the power terminal are each a center portion of the power terminal.

15. The liquid cartridge of claim 14, wherein the portion of the data terminal is a center portion of the data terminal, and the portion of the sensor terminal is a center portion of the sensor terminal.

16. The liquid cartridge of claim 1, wherein the first portion and the second portion of the power terminal are each an edge portion of the power terminal.

17. The liquid cartridge of claim 16, wherein the edge portion of the data terminal is a portion of the data terminal closest to the power terminal, and the edge portion of the sensor terminal is a portion of the sensor terminal closest to the power terminal.

18. The liquid cartridge of claim 1, wherein at least a portion of the power terminal is aligned with a particular portion of the sensor terminal in a particular direction, and at least a portion of the data terminal is aligned with a further portion of the sensor terminal in a further direction substantially perpendicular to the particular direction.

19. The liquid cartridge of claim 18, wherein the portion of the data terminal and any portion of the power terminal are not aligned in the further direction.

20. The liquid cartridge of claim 18, wherein the power terminal is adjacent to the sensor terminal in the particular direction, the sensor terminal is adjacent to the data terminal in the further direction.

21. The liquid cartridge of claim 1, further comprising a substrate, wherein the plurality of terminals is disposed on the substrate.

22. The liquid cartridge of claim 21, wherein each of the power terminal, data terminal, and sensor terminal are disposed on the substrate in a manner such that at least a portion of the substrate may be divided into a plurality of substantially rectangular areas disposed along a particular direction and a farther direction perpendicular to the particular direction, the plurality of areas comprising:

a first area, wherein at least a portion of the power terminal is disposed at a central portion of the first area;

a second area, wherein the sensor terminal is disposed at a central portion of the second area; and a third area, wherein the data terminal is disposed at a central portion of the third area, wherein the first area and the second area are adjacent in the particular direction, and the first area and third area are not adjacent in the particular direction or the further direction.

23. The cartridge of claim 1, wherein the data terminal comprises a data output terminal connected to the storage, and the plurality of terminals further comprises a data input terminal connected to the storage.

24. The cartridge of claim 23, wherein data stored in the storage is received at the data output terminal, and data received at the data input terminal is transmitted to the storage to be stored.

25. The cartridge of claim 23, wherein a distance between at least a third portion of the power terminal and at least a portion of the data input terminal is greater than a distance between at least a fourth portion of the power terminal and at least a portion of the data output terminal.

26. The cartridge of claim 23, wherein the data input terminal is positioned on an opposite side of the data output terminal from the power terminal.

27. A liquid cartridge comprising:

a liquid reservoir configured to store liquid therein;

a liquid flow path configured to selectively allow the liquid reservoir to be in fluid communication with an exterior of the liquid cartridge;

a sensor configured to output a signal relative to a position of an object other than the liquid disposed in the liquid flow path;

a storage configured to store data therein;

a plurality of terminals, wherein the plurality of terminals comprises:

a sensor terminal connected to the sensor;

a power terminal connected to at least one of the sensor and the storage, and configured to receive power from an exterior of the cartridge; and a data terminal connected to the storage, wherein a distance between at least a first portion of the power terminal and at least a portion of the data terminal is greater than a distance between at least a second portion of the power terminal and at least a portion of the sensor terminal, wherein the sensor is disposed outside the liquid flow path, and wherein the sensor comprises a magnetic sensor configured to selectively output a first signal and a second signal based on a magnetic flux density.

* * * * *